US010787786B2

(12) United States Patent
Beretta et al.

(10) Patent No.: US 10,787,786 B2
(45) Date of Patent: Sep. 29, 2020

(54) CONTAINING ELEMENT, STRUCTURE OF REINFORCED GROUND, PROCESS OF MAKING SAID STRUCTURE OF REINFORCED GROUND

(71) Applicant: TENAX GROUP SA, Lugano (CH)

(72) Inventors: Cesare Beretta, Castagnola (CH); Luca Mottadelli, Missaglia (IT)

(73) Assignee: TENAX GROUP SA, Lugano (CH)

( * ) Notice: Subject to any disclaimer, the term of this patent is extended or adjusted under 35 U.S.C. 154(b) by 0 days.

(21) Appl. No.: 15/570,705

(22) PCT Filed: Feb. 9, 2016

(86) PCT No.: PCT/IB2016/050674
§ 371 (c)(1),
(2) Date: Oct. 30, 2017

(87) PCT Pub. No.: WO2016/142792
PCT Pub. Date: Sep. 15, 2016

(65) Prior Publication Data

US 2018/0291584 A1 Oct. 11, 2018

(30) Foreign Application Priority Data

Mar. 6, 2015 (IT) ..... MI2015A0341

(51) Int. Cl.
*E02D 29/02* (2006.01)
*E02D 17/20* (2006.01)

(52) U.S. Cl.
CPC ..... *E02D 29/0266* (2013.01); *E02D 17/20* (2013.01); *E02D 17/205* (2013.01);
(Continued)

(58) Field of Classification Search
CPC ..... E02D 29/0266; E02D 17/205; E02D 29/0225; E02D 2300/002; E02D 2300/0006
(Continued)

(56) References Cited

U.S. PATENT DOCUMENTS 2,279,735 A * 4/1942 Gates ..... G09F 19/10 47/33
3,386,876 A * 6/1968 Wyckoff ..... B29C 55/04 428/134
(Continued)

FOREIGN PATENT DOCUMENTS

EP 1 340 857 A1 9/2003
EP 2 434 060 A1 3/2012
WO 99/032731 A1 7/1999

OTHER PUBLICATIONS

Oct. 30, 2015 Written Opinion issued in Italian Patent Application No. MI20150341.
(Continued)

*Primary Examiner* — Benjamin F Fiorello
*Assistant Examiner* — Edwin J Toledo-Duran
(74) *Attorney, Agent, or Firm* — Oliff PLC

(57) ABSTRACT

A containing element to be used in geotechnical applications, including: a facing body made of a cementitious material having an inner face configured for contacting the ground and an outer face opposite to the inner face with respect to the body itself, a monolithic reticular structure made of plastic material having a plurality of first and second elements intersecting each other at respective nodes in order to form meshes. The reticular structure includes a first portion integrated and stably embedded in the facing body and a second portion, integral with the first portion, emerging from the inner face of the facing body; the second
(Continued)

portion of the reticular structure defines, cooperatively with the inner face of the containing body, a closed loop.

9 Claims, 18 Drawing Sheets

(52) U.S. Cl.
CPC ..... *E02D 29/0225* (2013.01); *E02D 29/0241* (2013.01); *E02D 2300/002* (2013.01); *E02D 2300/0006* (2013.01)

(58) Field of Classification Search
USPC ..... 405/15, 17, 19, 21, 107, 110, 111, 115, 405/302.4, 302.6, 302.7, 262, 284, 285, 405/258, 259.1, 286; 403/376, 391; 256/19, 24
See application file for complete search history.

(56) References Cited

U.S. PATENT DOCUMENTS 3,686,873 A 8/1972 Vidal
4,295,296 A * 10/1981 Kinghorn ..... A01G 9/025 47/82
4,494,892 A * 1/1985 Wojciechowski .... E01F 15/083 404/6
4,728,227 A * 3/1988 Wilson ..... E02D 29/0241 405/262
4,824,293 A * 4/1989 Brown ..... E02D 29/0241 405/262
4,856,939 A * 8/1989 Hilfiker ..... E02D 29/0241 405/284
4,929,125 A * 5/1990 Hilfiker ..... E02D 29/025 405/262
5,044,833 A * 9/1991 Wilfiker ..... E02D 29/0241 405/262
5,053,264 A * 10/1991 Beretta ..... B29C 55/04 264/DIG. 81
5,257,476 A * 11/1993 Fukuzumi ..... A01G 9/025 47/65.8
5,417,523 A * 5/1995 Scales ..... E02D 29/0241 405/262
5,419,659 A * 5/1995 Mercer ..... B65D 71/504 405/302.7
5,435,669 A * 7/1995 Weber ..... E02D 29/025 405/284
5,451,120 A * 9/1995 Martinez-Gonzalez ..... E02D 29/0241 405/262
5,522,682 A * 6/1996 Egan ..... E02D 29/0241 405/262
5,540,525 A * 7/1996 Miller ..... E02D 29/0225 405/284
5,568,998 A * 10/1996 Egan ..... E02D 29/0241 403/391
5,568,999 A * 10/1996 Egan ..... E02D 29/0241 405/262
5,619,835 A * 4/1997 Bailey, II ..... E02D 29/0241 405/286
5,836,129 A * 11/1998 Jaecklin ..... E02D 17/20 52/612
5,851,089 A * 12/1998 Beretta ..... E02D 17/202 405/259.1
5,975,810 A * 11/1999 Taylor ..... E02D 29/0225 405/262
6,287,054 B1 * 9/2001 Egan ..... E02D 29/0241 405/262
6,336,773 B1 * 1/2002 Anderson ..... E02D 29/02 405/262
6,505,999 B1 * 1/2003 Lothspeich ..... E02D 29/0241 405/262
6,595,726 B1 * 7/2003 Egan ..... E02D 29/0241 405/262
6,725,601 B2 * 4/2004 Chick ..... E01F 8/027 47/39
7,407,699 B2 * 8/2008 Jacoby ..... B29C 55/14 428/136

OTHER PUBLICATIONS

May 11, 2016 International Search Report issued in International Patent Application No. PCT/IB2016/050674.
May 11, 2016 Written Opinion of the International Searching Authority issued in International Patent Application No. PCT/IB2016/050674.

* cited by examiner

PRIOR ART

FIG.19
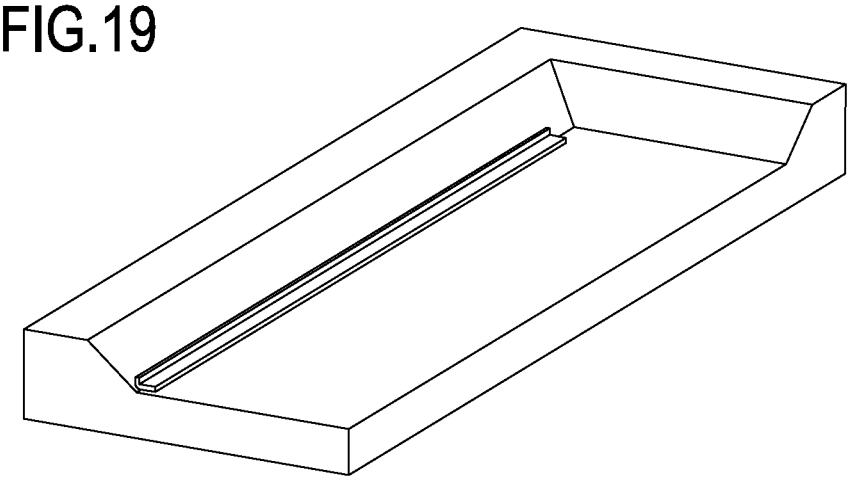
FIG.20
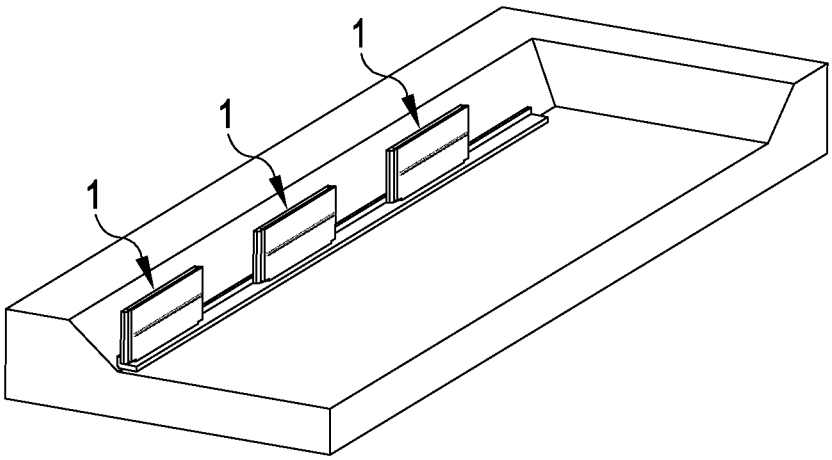
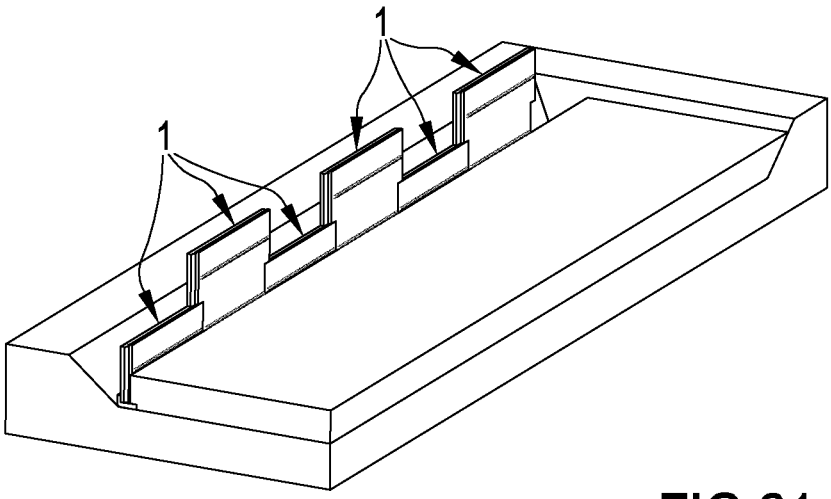
FIG.21

CONTAINING ELEMENT, STRUCTURE OF REINFORCED GROUND, PROCESS OF MAKING SAID STRUCTURE OF REINFORCED GROUND

FIELD OF THE INVENTION

The present invention refers to a containing element, a structure of reinforced ground and the relative processes of making said containing elements and reticular structure. Particularly, the containing element can find an application in the reinforced grounds for making vertically developing supporting faces and/or walls. Some further applicative examples of the containing element can be exemplified by natural slopes, green walls, block walls, artificial walls, landslide rehabilitation.

STATE OF THE ART

To date, reinforcing systems called reinforced grounds and made by bands or grids of metal or polymer materials, which are engaged inside the ground in order to form a series of containing horizontal layers, are well known in the geotechnical engineering field.

This technique has been long exploited for making vertically developing walls which provide a series of outer panels or blocks placed side by side in order to define a vertical or slightly sloped outer wall—adapted to receive the ground thrust; a series of bands or grids extending inside the ground in order to define a type of reinforcement are anchored to the blocks or panels. Based on this concept, different systems were devised for making containing structures, such as for example supporting walls for road constructions, bridge abutments, stabilizing works for slopes, dams, artificial tunnels. These systems can be substantially divided in two main macro-systems essentially defined by the capability of the block or panel of being a structural element rather than a non-structural one. The term "structural element" means an element made for intrinsically resisting the static load of the ground and requiring of being coupled to the ground. On the contrary, the non-structural elements are structures as the panels, which are not capable of resisting by themselves the ground load, so that they require ground reinforcing elements connected to the wall structure. With reference to the present discussion are of particular interest non-structural containing elements which, as hereinbefore specified, require bands and/or grids adapted to define a connection between the ground and the front facing element. In the following a series of known applications of containing elements with non-structural panels or blocks are discussed.

A first application is represented by a non-structural panel system combining ground works consisting of layers, metal reinforcing bands being interposed between one layer and the following and are made integral with a vertical outer facing. This first application is for example described in the U.S. Pat. No. 3,686,873 A disclosing reinforced grounds formed by a plurality of concrete panels (front facings) of small thickness (non-structural) to which linear elements consisting of steel bands are anchored: each band extends inside the ground from the panel in order to define a horizontal reinforcement strip. Specifically, each panel has one or more metal brackets exiting the panel, which are constrained, by bolts, to the metal bands in order to make the panels integral with the bands. While these structures enable to reinforce the ground and therefore to make vertical consolidation walls, this approach is not devoid of disadvantages and limitations. In fact, it is noted that it is necessary a large number of reinforcing bands which must be stably individually engaged with the front panels for reinforcing a considerable ground surface. Therefore, it is noted that the implementation of this type of system is somewhat cumbersome and onerous in terms of costs and times. Further, the reinforcing bands and the respective hooks (brackets) of the panel, are made of steel and therefore are oxidized/corroded by the ground. The oxidative effect of the ground can seriously compromise the containing capability of the reinforcing bands and of the respective brackets and consequently compromise the containing capability of the vertical wall. In order to enable the reinforcing bands to contain, these latter, in addition to the hooks, are coated by a layer of a polymeric material enabling to protect the steel from the oxidation. Providing the layer on each band and bracket makes the system still more complex and expensive.

Then, for solving the corrosion problems associated to the use of metal reinforcements, reinforcements formed by polymeric material strips, particularly made of a tensile strong core of polyester fibers of high toughness coated by a protective sheath of polyethylene (the outer protecting layer is necessary due to the low resistance of the polyester to the degradation, while polyethylene is capable of ensuring a good mechanical and chemical-physical protection) have been proposed for reinforced ground structures substantially of the same type already described (non-structural panel system). The reinforcing bands of these latter systems are therefore intrinsically resistant to the corrosion and do not require further treatments; this characteristic, in comparison with the above described steel band systems, enables to eliminate, when the bands are manufactured, at least the step of treating (coating) these latter. Omitting the step of coating the reinforcing bands makes simpler manufacturing the same and makes more economical the whole structure. Despite these latter systems are an improvement with respect to the first described applications (steel bands), it is noted that the panel brackets are made of a metal material and it is still necessary to provide a corrosion-resistant coating for them. Further, it is noted that the problem associated to the necessity of individually positioning and fixing a high number of bands to the panels is still present, which makes setting them up troublesome and therefore expensive the implementation thereof.

Further proposed techniques for making reinforced grounds provide, instead of the panels, the use of prefabricated concrete small blocks exhibiting a reduced face extension and a high thickness (the blocks can provide an internal metal reinforcement). The small blocks are configured for being coupled to each other and for receiving, at the coupling area, one or more metal material reinforcing bands adapted to define the ground formwork. Similar approaches are generally proposed with the aim of making more practical to transport, move and set-up the facing elements in comparison with the hereinbefore described panel approach. However, this kind of structures makes difficult to built them fast and, most of all, due to the low stability of the small blocks, does not enable to realize works having great vertical extensions. De facto, the outer facings made of concrete small blocks do not enable to make vertical outer walls (generally the outer wall is sloped) and enable to obtain maximum heights of about 6 m. Moreover, it is noted that, besides the stability problem of the small blocks, these latter approaches use metal-type bands consequently subjected to the ground corrosive effect. Some known systems with an outer facing made of concrete blocks do not use, as reinforcing formworks incorporated in the ground, the traditional metal bands or polymeric strips, but use reticular elements (nets) of polymeric material, known as geo-grids or geo-nets. The geo-nets are traditionally used in the geo-technical field for plural applications different from the one herein discussed, among them, for making both continuous and stepped reinforced slopes, and green walls, still having a sloped trend, wherein the covering concrete facing is absent. The geo-grids are usually made of a polymeric material, particularly of high-density polyethylene (HDPE), and are made particularly tensile strong by a process of stretching the article which provides the polymeric chains of the net with an unidirectional orientation. Using geo-grids inside ground structures having a vertical facing of the discussed type, enables to uniformly reinforce the ground from the inside and with a more effective action than the one provided by the anchoring systems formed by discrete strips or bands. An example of this kind of structure is described in the patent application WO99/32731 disclosing an outer wall made of small concrete blocks, the ends of flat layers of geo-grids (reinforcement) are interposed during the setting-up among the blocks. In fact, document WO99/32731 discloses the use of flat layers of plastic geo-grids horizontally extending inside the ground from the back face of the containing wall defined by the small concrete blocks. Despite these latter structures enable to uniformly reinforce the ground, and are not subjected to the problems of the formwork corrosion, also these latter are not devoid of disadvantages. De facto, as hereinbefore described, the blocks do not enable to obtain, due to the low stability of the same, high vertical extensions of the walls. Moreover, the engagement of the nets between the concrete blocks develops loads concentrated at the net nodes which often compromise the operation or even break the net. Additional proposed techniques for making reinforced ground provide the use of polyolefin grids partially embedded in the panel concrete casting configured for hooking a further geo-grid used for reinforcing the ground. Particularly, the portion of a first plastic material net is partially embedded in a panel so that this latter defines an open-outline strip or band emerging outside the panel; the strip is configured for enabling to be connected to a second plastic net which, at a terminal longitudinal portion, is interwoven with the first net and then is blocked by means of a metal material cross-bar (this the so called "Bodkin" engagement). The above described arrangement is certainly an improvement in comparison with the above discussed systems because the first and second nets are not subjected to corrosion. Moreover, as hereinbefore cited, using a net for reinforcing the ground enables to define an evenly distributed reinforcement. It is also noted that the nets for reinforcing a ground exhibit a development quite greater than the above described metal or plastic reinforcing bands; this condition therefore enables to cover and reinforce and extensive surface of the ground by laying down a reduced number of nets, enabling in this way to reduce the time and cost for laying them down. Even though this latter described arrangement enables to solve many of the above described problems in comparison with the previous approaches, also this latter variant is not devoid of limitations and disadvantages. De facto, the engagement of the two terminal portions of the plastic nets, as hereinbefore described, generates, during the step of tensioning the same, a high concentration of stresses just at the weakest points of the net, in other words in correspondence of the nodes of the nets. Therefore, the high tensions could compromise the operation of the net or even cause the breakage and consequently jeopardize the consolidation/containment of the ground.

Moreover, the present state of the art provides a different possibility for using the plastic geo-grids, particularly disclosed in the European patent EP1340857B1. Specifically, this document describes a system overcoming the difficulties of connecting to each other the nets, cited in the preceding approach (the stresses are concentrated at the nodes) and enables also to connect to each other two panels contiguous along the vertical development of the wall. This setting-up mode in fact provides to embed in the reinforced concrete panel metal U-shaped elements projecting from the same panel, serially arranged on two or more levels of the panel vertical development. A plastic geo-grid is folded and is placed in proximity of the rings of one or more panels so that at least one net portion is parallel to the panel development, while the rings cross the plastic net. The net is blocked to the panel by a metal material bar in order to define, also in this case, a Bodkin-type connection. This setting-up system, in comparison with the previously described one, exhibits this advantage: the connecting system between the panel and reinforcement grid does not require a determined tension (the net can be completely positioned and tensioned by the operators without a particular equipment) and moreover prevents the stresses from concentrating at the net nodes. However, this latter use exhibits the disadvantage of providing to integrate U-shaped metal brackets in the panel; this process is somewhat cumbersome and onerous in terms of material cost (the cost of the metal brackets and the cost of the process of engaging them in the panel). The number of metal brackets and therefore their distance is a tradeoff between the anchoring metal bar strength and the material cost. For minimizing the quantity of brackets and therefore reducing the overall cost of the whole panel, it is further necessary to provide a high strength bar and therefore necessarily made of a metal material. While in this case the metal bar enables to reduce the number of brackets, each metal element present in the set-up must be treated and covered with a corrosion-resistant material, for example PVC, for preventing them from being corroded by the ground. The disadvantage found in this condition is due to the necessity of performing additional treating processes of all the metal elements, such as the brackets and metal bar. Besides that, however, it is noted that a small number of brackets prevents to correctly and evenly distribute the loads on the panel in a operative condition of the net; in fact, an excessive tension on the net—for example caused by ground movements—could induce excessive stresses on the panel and damage it.

It is apparent from the above discussed state of the art that at the moment there are no known systems for economically making reinforced grounds which can be easily set up in order to enable at the same time to effectively contain the ground.

OBJECT OF THE INVENTION

Therefore, it is an object of the present invention to substantially solve at least one of the disadvantages and/or limitations of the preceding approaches.

A first object of the invention consists of providing a containing element enabling to simplify the setting-up of the same and therefore enabling to reduce the time and cost for making reinforced grounds. A further object of the present invention consists of providing a containing element which can ensure to correctly and evenly reinforce the ground. Particularly, it is an object of the invention to provide a containing element which can be used for making a variety of containing walls—for example of different size—and consequently provided with a good flexibility of use. It is a further object of the present invention to make a structured containing element so that the outer elements of the same directly contacting the ground, are made of an oxidation-resistant material; particularly the outer components of the containing element directly contacting the ground, are configured for not requiring additional treatments or coatings for resisting the ground corrosive action. Then, it is an object of the invention to provide a containing element which can effectively cooperate with the ground reinforcement elements. Then, it is an object to make available a process for efficiently making a containing element useable for geotechnical applications, particularly for making containing walls by means of reinforced ground.

One or more of the above described objects, which will better appear during the following description, are substantially met by a containing element and a process for making the same according to one or more of the accompanying claims.

SUMMARY

The aspects of the invention are described in the following.

In a 1st aspect, it is provided a containing element (1) to be used in geotechnical applications, particularly for making containing walls with reinforced ground, said containing element (1) comprising:

- at least one facing body (2), particularly of cementitious material, such as for example concrete, associable to the ground for defining a containment and support to the same, the facing body (2) comprising at least one inner face (2*a*) configured for contacting the ground and one outer face (2*b*) opposite to the inner face (2*a*) with respect to the body itself,
- at least one reticular structure (3), optionally monolithic, of plastic material, having a plurality of first elements (4) spaced from each other and developing along prevalent development paths, the reticular structure (3) having further a plurality of second elements (5) also spaced from each other which extend along respective development paths along a direction substantially transversal to the first elements (4), the first and second elements (4, 5) intersecting each other at respective nodes (6) in order to form meshes (7)
- the reticular structure (3) comprising at least one first portion (3*a*) integrated and stably embedded in the facing body (2) and one second portion (3*b*), integral with the first portion (3*a*), emerging from the inner face (2*a*) of the facing body (2),
- and wherein the second portion (3*b*) of the reticular structure (3) defines a plurality of slots (13) each of them, in cooperation with the inner face (2*a*) of the containing body (2), substantially defines a closed outline loop.

In a 2nd aspect according to the aspect 1, the plurality of slots (13) of the second portion (3*b*) of the reticular structure (3) are aligned along a predetermined rectilinear direction (D), particularly parallel to a prevalent development plane of the facing body (2).

In a 3rd aspect according to anyone of the preceding aspects, each slot (13) of the second portion (3*b*) of the reticular structure (3) has a substantially "C" or "U" shape having the concavity facing the inner face (2*a*) of the facing body (2).

In a 4th aspect according to anyone of the preceding aspects, each slot (13) of the second portion (3*b*) of the reticular structure (3) is integral with the facing body (2) and defines with the inner face (2) of this latter a closed loop.

In a 5th aspect according to anyone of the preceding aspects, the first portion (3*a*) of the reticular structure (3) comprises a first and second flaps (8, 9) spaced from each other and ending at the inner face (2*a*) of the facing body (2), the second portion (3*b*) of the reticular structure (3) having also a first and second flaps (10, 11) spaced from each other and integrally joined to the respective first and second flaps (8, 9) of the first portion (3*a*) of the reticular structure (3).

In a 6th aspect according to anyone of the preceding aspects, the first elements (4) of the reticular structure (3) extend substantially along the respective rectilinear prevalent development directions and parallel to a prevalent development plane of the facing body (2), and wherein at least some of the second elements (5) of the reticular structure define said second portion (3*b*) and extend along arc-shaped paths transversal to the prevalent development plane of the facing body (2).

In a 7th aspect according to anyone of the preceding aspects, the second portion (3*b*) of the reticular structure (3) comprises at least a plurality of second elements (5) emerging from the inner face (2*a*) of the facing body (2) and defining said slots (13), the plurality of second elements (5) being aligned along a predetermined rectilinear direction (D) parallel to a prevalent development plane of the facing body (2) itself.

In an 8th aspect according to the preceding aspect, the second portion (3*b*) of the reticular structure (3) comprises, for each linear meter measured along the predetermined aligning direction (D) of the slots (13), a number of second elements (5) greater than 10, particularly comprised between 20 and 100, still more particularly comprised between 30 and 70.

In a 9th aspect according to the aspect 7 or 8, the second elements (5) of the reticular structure (3) have a minimum distance from each to an immediately consecutive other, measured along the predetermined aligning direction (D) of the slots (13), less than 60 mm, particularly comprised between 10 and 50 mm, still more particularly comprised between 15 and 30 mm.

In a 10th aspect according to anyone of the preceding aspects, the second portion (3*b*) of the reticular structure (3) comprises only second elements (5), particularly the second portion (3*b*) of the reticular structure (3) being devoid of the first elements (4).

In an 11th aspect according to anyone of the preceding aspects, the first elements (4) of the reticular structure (3) are all completely embedded in the facing body (2).

In a 12th aspect according to anyone of the preceding aspects, the second elements (5) are stretched along their prevalent development direction after being formed and exhibit a structure having molecular chains oriented along their prevalent development direction.

In a 13th aspect according to anyone of the preceding aspects, the second elements (5) are obtained by extrusion followed by a stretching step.

In a 14th aspect according to the aspect 12 or 13, the second elements (5) exhibit a stretching ratio greater than 3, optionally comprised between 3 and 8, more optionally between 4 and 7, the stretching ratio of the second elements being defined as the ratio between a final length of the second elements after stretching the same to an initial length of the second elements before stretching them.

In a 15th aspect according to anyone of the preceding aspects, each second element (5) of said plurality, defining the second portion (3*b*) of the reticular structure (3), substantially defines a slot.

In a 16th aspect according to the preceding aspect, the perimetral extension of the slot defined by a second element (5) is comprised between 50 and 500 mm, particularly between 80 and 300 mm.

In a 17th aspect according to anyone of the preceding aspects, each closed outline loop, defined by the cooperation of a slot (13) and inner face (2*b*) of the facing body (2), defines an inner passage area comprised between 8 and 800 $cm^2$, particularly comprised between 20 and 300 $cm^2$.

In an 18th aspect according to anyone of the aspects from 7 to 17, the plurality of slots (13) define, along the predetermined direction (D), a type of channel longitudinally delimited by terminal opposite slots (13).

In a 19th aspect according to the preceding aspect, the channel exhibits a length, defined by the maximum measured distance between said opposite terminal slots (13), greater than 500 mm, particularly comprised between 700 and 2000 mm.

In a 20th aspect according to anyone of the preceding aspects, the first elements (4) are unstretched or exhibit a smaller stretching ratio, optionally at least half the ratio of the second elements (5), the stretching ratio of an element being defined as a ratio of a final length of the same element after being stretched, to the initial length of such element before stretching it.

In a 21st aspect according to the preceding aspect, the first elements (4) exhibit a stretching ratio comprised between 1 and 1.5, the stretching ratio of the first elements (4) being defined as a ratio of a final length of the first elements after a possible stretching step, to an initial length of the first elements before stretching them.

In a 22nd aspect according to the aspect 20 or 21, the first elements (4) are not stretched after being formed.

In a 23rd aspect according to anyone of the preceding aspects, the first elements (4) of the reticular structure (3) exhibit a total extension or length greater than 500 mm, particularly comprised between 700 and 2000 mm, the total length of a first element (4) being defined by summing the maximum distances present between all the aligned and consecutive nodes (6) along said same first element (4).

In a 24th aspect according to anyone of the preceding aspects, the second elements (5) are configured for freely bending along at least one axis transversal to the second elements themselves, particularly the second elements (5) are configured for freely bending along at least one transversal axis substantially parallel to said first elements.

In a 25th aspect according to anyone of the preceding aspects, the first and second elements (4, 5) exhibit a solid cross-section, the cross-section area of the first elements (4) being at least 5 times greater than the cross-section area of the second elements (5).

In a 26th aspect according to anyone of the preceding aspects, the first elements (4) exhibit a cross-section area greater than 15 $mm^2$, optionally greater than 30 $mm^2$.

In a 27th aspect according to anyone of the preceding aspects, the second elements (5) exhibit a cross-section area greater than 3 $mm^2$, optionally greater than 4 $mm^2$.

In a 28th aspect according to anyone of the preceding aspects, at least the second elements (5) exhibit portions, extending between consecutive nodes (6), exhibiting width terminal areas, measured parallelly to the first elements (4), progressively decreasing from a node (6) towards a centre line of said portions and a central area having a substantially constant width and less than the one of the terminal areas.

In a 29th aspect according to anyone of the preceding aspects, the reticular structure (3) exhibits:

an areal mass (weight by surface unit) greater than 200 $g/mm^2$, optionally between 200 and 1200 $g/mm^2$; optionally a specific tensile strength, along the second elements, greater than 20 kN/m, particularly comprised between 20 and 250 kN/m, optionally between 60 and 200 kN/m, said specific tensile strength being measured by the method set out in the description.

In a 30th aspect according to anyone of the preceding aspects, the first elements (4) and second elements (5) are substantially normal to each other.

In a 31st aspect according to anyone of the preceding aspects, the reticular structure (3) is only formed by the first and second elements (4, 5).

In a 32nd aspect according to anyone of the preceding aspects, the facing body (2) comprises at least one reinforcement (12), particularly made of metal material, embedded in the body itself.

In a 33rd aspect according to the preceding aspect, the reinforcement (12) of the facing body (2) comprises at least one metal material grid.

In a 34th aspect according to the aspect 32 or 33, the reticular structure (3) is engaged with the reinforcement (12) of the facing body (2), particularly the first portion (3*a*) of the reticular structure (3) being stably constrained to the reinforcement (12) of the facing body (2).

In a 35th aspect according to anyone of the preceding aspects, the facing body (2) substantially comprises a panel exhibiting a surface extension, defined by the length and width of the same, substantially greater than its thickness, optionally the panel exhibiting a thickness, defined by the distance present between the inner face (2*a*) and outer face (2*b*) of the facing body (2), greater than 80 mm, particularly comprised between 100 and 250 mm.

In a 36th aspect according to the preceding aspect, the panel of the facing body (2) exhibits substantially a rectangular or square shape.

In a 37th aspect according to anyone of the preceding aspects, the panel of the facing body (2) exhibits a surface extension greater than 10000 $cm^2$, particularly comprised between 15000 and 50000 $cm^2$.

In a 38th aspect according to anyone of the preceding aspects, the reticular structure (3) is completely made of a plastic material, particularly at least one selected in the group of the following materials: PE, HDPE, LDPE, PP, PVC, PS.

In a 39th aspect according to anyone of the preceding aspects, the reticular structure is monolithic and of plastic material.

In a 40th aspect according to anyone of the preceding aspects, the reticular structure (3) comprises one or more of said second portions (3*b*) emerging from the inner face (2*a*) of the facing body (2) and respective first portions (3*a*), each of said second portions (3*b*) defining a respective plurality of slots (13).

In a 41st aspect, it is provided a process of making a containing element (1) according to anyone of the preceding aspects, comprising at least the steps of:

providing the reticular structure (3), providing a formwork (20) configured for receiving and containing a predetermined quantity of material, particularly a cementitious material, such as for example concrete, and for defining the facing body (2), positioning the reticular structure (3) inside the homework, pouring the predetermined quantity of material at least partially at a liquid state inside the formwork (20)

wherein the step of providing the reticular structure (3) provides at least one step of folding the same in order to define a series of slots (13), the step of pouring the predetermined quantity of material inside the formwork (20) enables to fill this latter to a predetermined level defining the inner face (2*a*) of the facing body (2) and above such level the plurality of slots (13) of the reticular structure (13) at least partially emerge.

In a 42nd aspect according to the preceding aspect, wherein the step of providing the reticular structure (3) enables to align the plurality of slots (13) of the second portion (3*b*) of the reticular structure (3) along a predetermined rectilinear direction (D), particularly parallel to a prevalent development plane of the facing body (2).

In a 43rd aspect according to anyone of the preceding aspects, the step of providing the reticular structure (3) enables to provide each slot with a substantially "C" or "U" shape having a concavity facing the inner face (2*a*) of the facing body (2), each slot (13) of the second portion (3*b*) of the reticular structure (3) being integral with the facing body (2) and defining with the inner face (2*a*) of this latter a closed outline loop.

In a 44th aspect according to anyone of the aspects from 41 to 43, the step of providing the reticular structure (3) enables to define, for this latter, at least the following portions:

at least one first portion (3*a*) exhibiting at least one first and one second flaps (8, 9) spaced from each other, embedded in the facing body (2) and ending at the inner face (2*a*) of this latter, at least one second portion (3*b*) exhibiting also a first and second flaps (10, 11) spaced from each other and integrally joined to the respective first and second flaps (8, 9) of the first portions (3*a*) of the reticular structure (3).

In a 45th aspect according to anyone of the aspects from 41 to 44, the step of providing the reticular structure (3) provides at least the following steps:

providing the first elements (4) along the respective rectilinear prevalent development directions parallel to a prevalent development plane of the facing body (2), providing the second elements (5) of the second portion (3*b*) of the reticular structure (3) along arc-shaped paths transversal to the prevalent development plane of the facing body (2).

In a 46th aspect according to anyone of the aspects from 41 to 45, the second portion (3*b*) of the reticular structure (3) comprises at least one plurality of second elements (5) emerging from the inner face (2*a*) of the facing body (2) and defining the slots (13), the step of providing the reticular structure (3) provides to align said plurality of second elements (5) defining said slots along a predetermined rectilinear direction (D) parallel to a prevalent development plane of the facing body (2) itself.

In a 47th aspect according to anyone of the aspects from 41 to 46, the second portion (3*b*) of the reticular structure (3) comprises, for each linear meter measured along the predetermined direction (D), a number of slots, particularly of the second elements (5), greater than 10, particularly comprised between 20 and 100, still more particularly comprised between 30 and 70.

In a 48th aspect according to anyone of the aspects from 41 to 47, the second elements (5) of the reticular structure (3) exhibit a minimum distance from each to an immediately consecutive other, measured along the predetermined distance (D), less than 60 mm, particularly less than 50 mm, still more particularly comprised between 15 and 30 mm.

In a 49th aspect according to anyone of the aspects from 41 to 48, the step of providing the reticular structure (3), with the step of pouring the predetermined quantity of cementitious material, enables to make a second portion (3*b*) formed only by second elements (5), particularly the second portion (3*b*) of the reticular structure (3) being devoid of the first elements (4).

In a 50th aspect according to anyone of the aspects from 41 to 49, the first elements (4) of the reticular structure (3) are all completely embedded in the facing body (2).

In a 51st aspect according to anyone of the aspects from 41 to 50, the first elements (4) and said second elements (5) are formed from a perforated plate of plastic material formed in a laminating or calendering station or are continuously formed by hot coextrusion in an extrusion station, and wherein the reticular structure (3) outlet direction from said laminating station, or, respectively, from said extrusion station, is parallel to the prevalent development direction of the first elements (4) or of the ones of the second elements (5).

In a 52nd aspect according to the preceding aspect, the second elements (5), optionally taken to a temperature greater than or equal to 80° C., are stretched and elongated at least by 300, and wherein said first elements (4) are not stretched after forming them or are stretched to a less extent than the stretch provided to the second elements (5).

In a 53rd aspect according to anyone of the aspects from 41 to 52, the step of providing the reticular structure provides, after forming the first and second elements (4, 5), at least one step of stretching the second elements (5) by a stretching ratio greater than 3, optionally comprised between 3 and 8, more optionally between 4 and 7, the stretching ratio of the second elements (5) being defined as the ratio between one final length of the second elements after stretching the same to an initial length of the second elements before stretching them.

In a 54th aspect according to anyone of the aspects from 41 to 53, each second element (5) of said plurality defining the second portion (3*b*) of the reticular structure (3) substantially defines a slot (13) whose perimetral extension is comprised between 50 and 500 mm, particularly between 80 and 300 mm.

In a 55th aspect according to anyone of the aspects from 41 to 54, each closed outline loop, defined by the cooperation of a slot 13 and the inner face (2*b*) of the facing body (2), exhibits a passage inner area comprised between 8 and 800 $cm^2$, particularly comprised between 20 and 300 $cm^2$.

In a 56th aspect according to anyone of the aspects from 41 to 55, the plurality of the second elements (5) of the reticular structure (3) substantially define, along the predetermined direction (D) aligning the slots (13), a kind of channel longitudinally delimited by terminal opposite slots (13), the channel exhibiting a length, defined by the maximum distance measured between said terminal opposite slots (13), greater than 500 mm, particularly comprised between 700 and 2000 mm.

In a 57th aspect according to anyone of the aspects from 41 to 56, the first elements (4) are unstretched or exhibit a smaller stretching ratio, optionally at least half, than the one of the second elements (5), the stretching ratio of one element being defined as a ratio of a final length of the same element once has been stretched to the initial length of such element before being stretched.

In a 58th aspect according to the preceding aspect, the first elements (4) exhibit a stretching ratio comprised between 1 and 1.5, optionally wherein the first elements (4) are not stretched after being formed, the stretching ratio of the first elements (4) being defined as a ratio between a final length of the first elements after possibly stretching them to an initial length of the first elements before stretching them.

In a 59th aspect according to anyone of the aspects from 41 to 58, the step of providing the reticular structure (3) defines first elements (4) exhibiting a total length greater than 500 mm, particularly comprised between 700 and 2000 mm.

In a 60th aspect according to anyone of the aspects from 41 to 59, the step of providing the reticular structure (3) defines second elements (5) configured for freely bending at least along an axis transversal to the second elements themselves, particularly the second elements are configured for freely bending along at least one transversal axis substantially parallel to said first elements.

In a 61st aspect according to anyone of the aspects from 41 to 60, the step of providing the reticular structure defines first and second elements (4, 5) exhibiting a solid cross-section, the area of the cross-section of the first elements (4) being at least 5 times greater than the area of the cross-section of the second elements (5), optionally wherein said first elements (4) exhibit a cross-section area greater than 15 $mm^2$, particularly greater than 30 $mm^2$; optionally wherein said second elements (5) exhibit a cross-section area greater than 3 $mm^2$, particularly greater than 4 $mm^2$.

In a 62nd aspect according to anyone of the aspects from 41 to 61, at least the second elements (5) exhibit portions, extending between consecutive nodes (6), with terminal areas having a width, measured parallelly to the first elements (4), progressively decreasing from a node (6) in the direction of a centre line of said portions and a central area having a substantially constant width and less than the one of the terminal areas.

In a 63rd aspect according to anyone of the aspects from 41 to 62, the reticular structure (3) exhibits:

an areal mass (weight by surface unit) greater than 200 $g/m^2$, optionally between 200 and 1200 $g/m^2$;

a specific tensile strength, along the second elements, greater than 20 kN/m, particularly comprised between 20 and 250 kN/m, optionally between 60 and 200 kN/m, said specific tensile strength being measured by a method set out in the description.

In a 64th aspect according to anyone of the aspects from 41 to 63, the first elements (4) and second elements (5) are substantially normal to each other.

In a 65th aspect according to anyone of the aspects from 41 to 64, the step of providing the formwork (20) provides to position inside the same at least one reinforcement (12) so that, at the end of the step of pouring the material inside the formwork (20) itself, the formwork is totally embedded in the facing body (2).

In a 66th aspect according to the preceding aspect, the reinforcement (12) of the facing body (2) comprises at least one grid of metal material.

In a 67th aspect according to the aspect 65 or 66, the step of positioning the reticular structure (3) inside the formwork (20) provides to engage the reticular structure to the reinforcement (12), particularly the first portion (3*a*) of the reticular structure (3) being stably constrained to the reinforcement (12) of the facing body (2).

In a 68th aspect according to anyone of the aspects from 41 to 67, the facing body (2) substantially comprises a panel exhibiting a surface extension, defined by the length and width of the same, substantially greater than its thickness, optionally the panel exhibits a thickness, defined by the distance between the inner face (2*a*) and outer face (2*b*) of the facing body (2), greater than 80 mm, particularly comprised between 100 and 250 mm.

In a 69th aspect according to the preceding aspect, the panel of the facing body (2) exhibits a substantially rectangular or square shape.

In a 70th aspect according to anyone of the aspects from 41 to 69, the panel of the facing body (2) exhibits a surface extension greater than 10000 $cm^2$, particularly comprised between 15000 and 50000 $cm^2$.

In a 71st aspect according to anyone of the aspects from 41 to 70, the reticular structure (3) is totally made of a plastic material, particularly at least one selected in the group of the following materials: PE, HDPE, LDPE, PP, PVC, PS.

In a 72nd aspect according to anyone of the aspects from 41 to 71, the reticular structure (3) comprises two or more of said second portions (3*b*) emerging from the inner face (2*a*) of the facing body (2) and respective first portions (3*a*), each of said second portions (3*b*) defining a respective plurality of slots (13).

In a 73rd aspect, it is provided a structure of reinforced ground (100), comprising:

a plurality of containing elements (1) according to anyone of the aspects from 1 to 40, which according to an operative condition of the same, are arranged in a vertical position by overlapped rows, each of said containing elements (1) exhibiting at least one second portion (3*a*) of the reticular structure (3) emerging from the inner face (2*a*) of the facing body (2) in order to define a plurality of slots (13), a predetermined number of monolithic reinforcement nets (14) of a plastic material, each of them comprises a plurality of first elements (15) spaced from each other and developing along prevalent development paths, each reinforcement net (14) further exhibiting a plurality of second elements (16) also spaced from each other which extend along respective prevalent development paths in a direction substantially transversal to the first elements (15), the first and second elements (15, 16) intersecting each other at respective nodes (17) in order to form meshes (18), at least a series of second elements (16) of said net (14), comprised between two adjacent immediately consecutive first elements (15), being inserted and interwoven with a plurality of slots (13) of the containing element (1), said structure (100) further comprising:

at least one locking bar (19) engaged inside the plurality of slots (13) so that the series of second elements (16) of the net (14) is interposed between the facing body (2) and locking bar (19), said locking bar (19) being configured for stably constraining the reinforcement net (14) to the containing element (1).

In a 74th aspect according to the preceding aspect, the reinforcement net (14) exhibits at least one portion placed in a horizontal position inside the ground at a level of a plurality of aligned slots (13).

In a 75th aspect according to the aspect 73 or 74, at least one of the reinforcement nets (14) defines the layers exhibiting, along a cross-section of the structure itself, a substantially two-dimensional development, said reinforcement net (14) comprising at least two rectilinear segments, spaced from each other and transversally positioned, particularly normal to, with respect to a prevalent development plane of the facing body (2), said reinforcement net (14) further comprising at least one connecting segment (23) interposed between the rectilinear segments and integrally joined to these latter, the connecting segment (23) extending parallelly to the inner face (2*a*) of one or more facing bodies (2), said reinforcement net (14) defining, according to a cross-section, a substantially "C" shape having the concavity facing away from the facing bodies (2), said reinforcement net (14) being interwoven and being engaged by respective locking bars (19) with two or more rows of slots (13) distinct and spaced from each other.

In a 76th aspect according to the preceding aspect, the connecting segment (23) of the reinforcement net (14) is integrally joined to two rectilinear segments by means of respective joining portions, each of them is interwoven with a plurality of slots (13) of the same reticular structure (3), the locking bar (19) being interposed between a joining portion of the reinforcement net (14) and a plurality of slots (13) of one or more reticular structures (3).

In a 77th aspect according to anyone of the aspects from 73 to 76, the first net (14) elements (15) extend substantially along respective rectilinear prevalent development directions parallel to a prevalent development plane of the facing body (2), and wherein at least the second net (14) elements (16) extend along paths transversal to the prevalent development plane of the facing body (2).

In a 78th aspect according to anyone of the aspects from 73 to 77, the second net (14) elements (16) are stretched along their prevalent development direction after being formed and exhibit a structure having molecular chains oriented along their prevalent development direction, particularly wherein the second net element (16) are obtained by extrusion followed by a stretching step.

In a 79th aspect according to anyone of the aspects from 73 to 78, the second net (14) elements (16) exhibit a stretching ratio greater than 3, optionally comprised between 3 and 8, more optionally between 4 and 7, the stretching ratio of the second elements being defined as the ratio of a final length of the second elements after being stretched to an initial length of the second elements before being stretched.

In an 80th aspect according to anyone of the aspects from 73 to 79, the first net (14) elements (15) are not stretched or exhibit a stretching ratio smaller, optionally at least half, than the one of the second net (14) elements (16), the stretching ratio of an element being defined as a ratio between a final length of the same element once has been stretched to the initial length of such element before being stretched.

In an 81st aspect according to the preceding aspect, the first net (14) elements (15) exhibit a stretching ratio comprised between 1 and 1.5, optionally wherein the first net (14) elements (15) are not stretched after being formed, the stretching ratio of the first net (14) elements (15) being defined as a ratio of a final length of the first elements after being possibly stretched to an initial length of the first elements before being stretched.

In an 82nd aspect according to anyone of the aspects from 73 to 81, the first and second elements (15, 16) exhibit a solid cross-section, the cross-section area of the first elements (15) being at least 5 times greater than the cross-section area of the second elements (5), particularly, wherein said first elements (5) exhibit a cross-section area greater than 15 $mm^2$, optionally greater than 30 $mm^2$;

particularly, wherein said second elements (16) exhibit a cross-section area greater than 3 $mm^2$, optionally greater than 4 $mm^2$.

In an 83rd aspect according to anyone of the aspects from 72 to 82, at least the second elements (16) of the reinforcement net (14) exhibit portions, extending between consecutive nodes (17), exhibiting terminal areas having a width, measured parallelly to the first net (14) elements (15), progressively decreasing from a node (17) towards a centre line of said portions and a central area having a width substantially constant and less than the one of the terminal areas.

In an 84th aspect according to anyone of the aspects from 73 to 83, the reinforcement net (14) exhibits:

an areal mass (weight by surface unit) greater than 200 $g/m^2$, optionally between 200 and 1200 $g/m^2$;

a specific tensile strength, along the second elements, greater than 20 kN/m, particularly comprised between 20 and 250 kN/m, optionally between 60 and 200 kN/m, said specific tensile strength being measured by a method set out in the description.

In an 85th aspect according to anyone of the aspects from 73 to 84, the first elements and second elements of the reinforcement net (14) are substantially normal to each other.

In an 86th aspect according to anyone of the aspects from 73 to 85, the reinforcement net (14) is completely made of a plastic material, particularly at least one selected in the group of the following materials: PE, HDPE, LDPE, PP, PVC, PS.

In an 87th aspect according to anyone of the aspects from 73 to 86, the first elements (4) of the containing element (1) exhibit substantially the same shape and structure as the first elements (15) of the reinforcement net (14).

In an 88th aspect according to anyone of the aspects from 73 to 87, the second elements (4) of the containing element (1) exhibit substantially the same structure, particularly the same cross-section, of the second elements (15) of the reinforcement net (14).

In an 89th aspect according to anyone of the aspects from 73 to 88, the reticular structure (3) of the containing element exhibits substantially the same characteristics of areal mass and tensile strength as the reinforcement net (14).

In a 90th aspect according to anyone of the aspects from 73 to 89, the locking bar (19) is at least partially, particularly completely, made of a plastic material.

In a 91st aspect according to anyone of the aspects from 73 to 90, the locking bar (19) is monolithic and of a plastic material.

In a 92nd aspect according to anyone of the aspects from 73 to 91, the locking bar (19) is made of at least one material selected in the group of the following materials: PE, HDPE, LDPE, PP, PVC, PS.

In a 93rd aspect according to anyone of the aspects from 73 to 92, the locking bar (19) exhibits a cross-section, particularly a solid one, defining an area less than 800 $cm^2$, particularly comprised between 10 and 500 $cm^2$, still more particularly comprised between 20 and 300 $cm^2$.

In a 94th aspect according to anyone of the aspects from 73 to 93, the locking bar (19) exhibits a circular cross-section having a diameter less than 40 mm, particularly less than 30 mm, still more particularly comprised between 10 and 25 mm.

In a 95th aspect according to anyone of the aspects from 73 to 94, the reticular structure (3) of the containing element (1), the locking bar (19) and reinforcement net (14) are respectively made of a plastic material, particularly are all completely made of a plastic material.

In a 96th aspect, it is provided a process of making a reinforced ground structure (100) according to anyone of the aspects from 73 to 95, the process comprising at least the following steps:

providing a plurality of containing elements (1) according to anyone of the aspects from 1 to 40, providing a predetermined number of reinforcement nets (14), after providing the containing elements (1) and reinforcement nets (14), the process provides at least the following steps:

positioning at least one first series of containing elements (1) aligned along a predetermined path in order to form a type of wall wherein the inner faces (2*a*) of the respective facing bodies (2) are all facing the same side, laying at least one reinforcement net (14) at a plurality of slots (13) of a reticular structure (3), the reinforcement net extending from said plurality of slots (13) of a facing body (2) away from this latter in a rectilinear direction, particularly horizontal, in order to define a first segment (21), inserting at least one portion of said reinforcement net (14) in said plurality of slots (13), engaging at least one locking bar (19) between said plurality of slots (13) and the portion of the reinforcement net (14) inserted in these latter, the locking bar (19) being interposed between the plurality of slots (13) and reinforcement net (14) for stably constraining them.

In a 97th aspect according to the preceding aspect, the step of inserting the reinforcement net (14) in the plurality of slots (13) defines an interpenetration of said reinforcement net (14) in the second portion (3*b*) of the reticular structure (3) of the containing element (1), the cooperation between the plurality of slots (13) and the interpenetrating portion of the reinforcement net (14) defining, along the direction aligning the plurality of slots (13), a series of closed loops, the locking bar (19) being engaged inside said closed loops.

In a 98th aspect according to the aspect 96 or 97, the step of inserting the reinforcement net (14) into the plurality of slots (13) comprises a step of interpenetrating a plurality of second elements (16) of said net (14) with a plurality of second elements (5) of the reticular structure (3) defining said plurality of slots (13).

In a 99th aspect according to anyone of the aspects from 96 to 98, the step of laying the first segment (21) of the reinforcement net (14), the step of providing this latter further provides at least the following sub-steps:

laying, as an extension of the first segment (21), a further portion of the reinforcement net (14) upwardly behind at least one facing body (2) so that the further net (14) portion is substantially parallel to the development plane of the facing body (2), pouring, on the first segment (21) of the reinforcement net (14), a predetermined quantity of ground in order to define at least one ground layer which further abuts against the further portion of the reinforcement net (14), turning a further portion of the reinforcement net (14) over the ground layer in order to define a second net rectilinear segment (22) extending away from the facing body (2), the further portion of the reinforcement net (14), upwards from the facing body (2), defining a connecting segment (23) between the first and second segments (21, 22) of the reinforcement net (14), the first segment (21), the connecting segment (23) and the second segment (22) defining at least one portion of the reinforcement net (14) exhibiting, along a cross-section, a substantially "C" shape, the concavity thereof faces away from the facing body (2) and receives inside the ground layer.

In a 100th aspect according to the preceding aspect, wherein before the step of turning over the reinforcement net (14), the process further provides the following steps:

inserting at least one further portion of said reinforcement net (14) in a further plurality of slots (13), engaging at least one further locking bar (19) between said further plurality of slots (13) and the further portion of the reinforcement net (14) inserted in these latter, the further locking bar (19) being interposed between said plurality of slots (13) and said reinforcement net (14) for stably constraining them.

In a 101st aspect according to the preceding aspect, the step of inserting the reinforcement net (14) into the further plurality of slots (13) defines an interpenetration of said reinforcement net (14) in the second portion (3*b*) of the reticular structure (3) of the containing element (1), the cooperation between the further plurality of slots (13) and the interpenetrating portion of the reinforcement net (14) defining, along the alignment direction of the plurality of slots (13), a further series of closed loops, the further locking bar (19) being engaged inside said closed loop.

In a 102nd aspect according to the preceding aspect, the connecting segment (23) of the reinforcement net (14) is integrally joined to the first and second segments (21, 22) by means of respective joining portions, each of them is inserted into a respective plurality of slots (13).

In a 103rd aspect according to anyone of the aspects from 96 to 102, the process comprises providing and engaging a plurality of reinforcement nets (14) with a plurality of containing elements in order to define a plurality of reinforced ground layers.

In a 104th aspect according to anyone of the aspects from 96 to 103, after pouring the predetermined quantity of ground on the first net (14) segment (21), the ground is pressed and compacted.

In a 105th aspect, it is provided a process of making a containing element according to anyone of the aspects from 1 to 40.

In a 106th aspect, it is provided a process of making a reinforced ground structure according to anyone of the aspects from 73 to 95.

In a 107th aspect, it is provided an use of a containing element (1) according to anyone of the aspects from 1 to 40 for making grounds for stabilizing landslide-prone slopes, supporting walls, road and railway embankments, extension of slopes, banks and landfills, rock fall barriers.

BRIEF DESCRIPTION OF THE DRAWINGS

Some embodiments and some aspects of the invention will be described in the following with reference to the accompanying drawings, given only in an indicative and therefore non limiting way, wherein.

Figure 1:
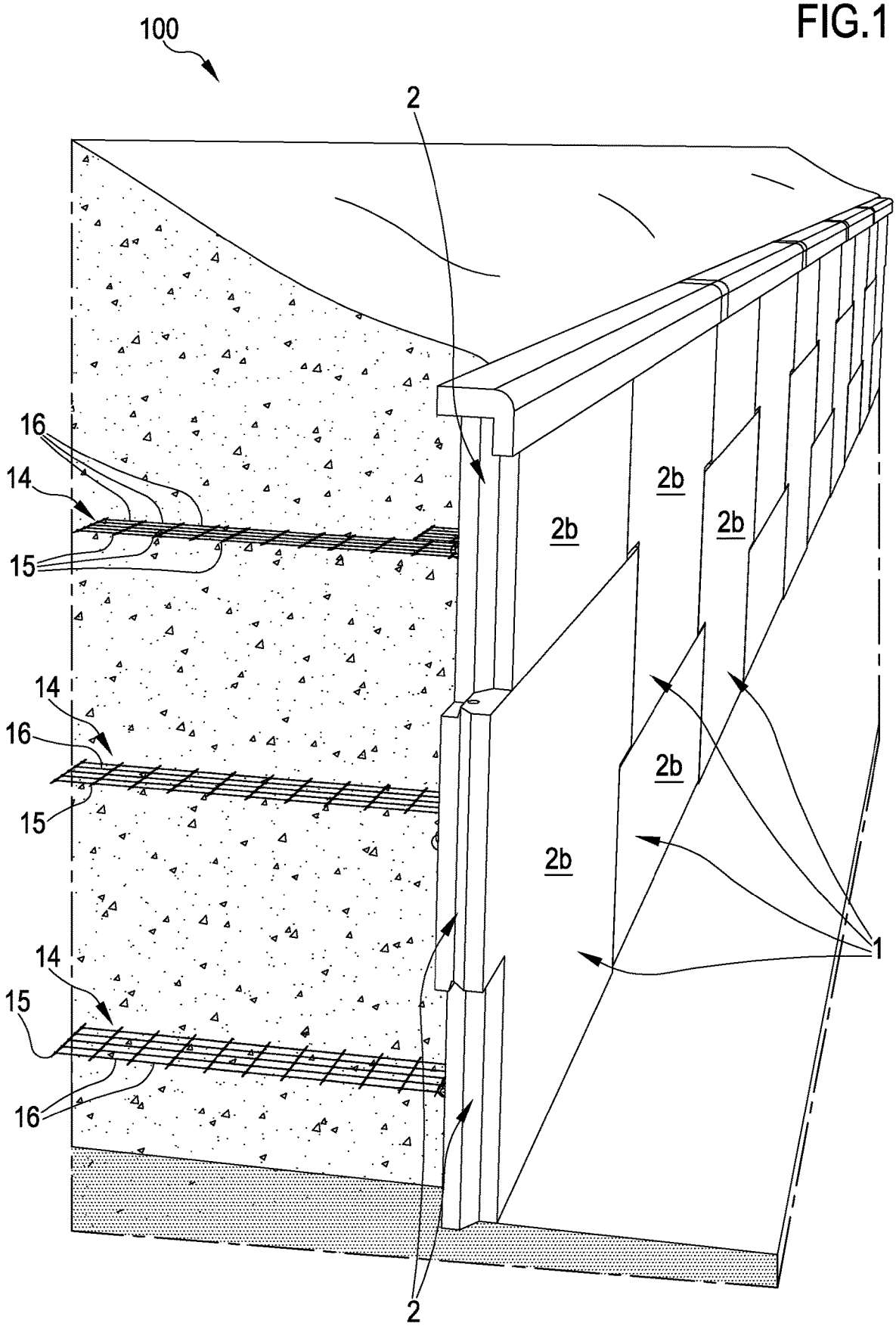
FIGS. 1 and 2 are respective perspective views of a structure made of reinforced ground according to the present invention.

FIGS. from 16 to 18 schematically show operative conditions of reinforcement structures according to the prior art;

FIGS. from 19 to 23 schematically show possible steps of a process of making a ground reinforced structure according to the present invention;

FIGS. from 24 to 26 schematically show some possible steps of a process of making a containing element according to the present invention.

DETAILED DESCRIPTION

Containing Element 1

1 generally indicates a containing element to be used in geotechnical applications, and in particular for making systems reinforcing and containing grounds. For example, the containing element 1 can find an application in the reinforced grounds for making vertically extending supporting faces and/or walls. Some further applicative examples of the containing element 1 can be represented by natural slopes, green walls, block walls, artificial walls, landslide rehabilitation.

The containing element 1 comprises a facing body 2 associable to the ground for defining a containment and support for the same. De facto, as it will be better explained in the following, the facing body 2 is configured for defining the ground boundary element adapted to receive the thrust of the ground and contain it. As it is visible for example in FIGS. 1 and 2, the facing body 2 comprises an inner face 2*a* configured for facing and contacting the ground, and an outer face 2*b* opposite to the inner face 2*a* with respect to the body itself. The accompanying figures illustrate a preferred but non limiting configuration of the invention so that the facing body 2 substantially comprises a panel having a rectangular or square shape exhibiting a surface extension, defined by the length and width of the same, essentially greater than the thickness. From the dimensional point of view, the panel can exhibit a minimum size—defined by the length and width of the panel—greater than 0.5, particularly comprised between 1 and 3 m, still more particularly between 1.5 and 2.0 m. From the surface extension point of view, the panel can define an area greater than 1 $m^2$, particularly comprised between 1.5 and 5 $m^2$. The dimensions of the panel (surface extension) enable a large face development for ensuring an optimal efficiency during the step of laying and assembling the system for maintaining an optimal flexibility in order to adapt to different design configurations. In case the facing body comprises a panel, this latter would exhibit a thickness defined by the distance between the inner face 2*a* and outer face 2*b* of the facing body 2, substantially smaller than the length and width of the same; optionally the thickness of the panel can be less than 20 cm, particularly is comprised between 7 and 18 cm. It is not excluded the possibility of making a facing body 2 comprising substantially a block having essentially the shape of a cube; in this latter case, the thickness would not be substantially smaller than the length and width of the block.

From the material point of view, the facing body 2 can be made of a cementitious material, and particularly of concrete (the panels can be prefabricated, for example). As it is visible in the attached figures, the facing body 2 can further comprise at least one reinforcement 12 embedded inside the body (embedded inside the panel, in the attached figures) and exhibiting, in a non limiting way, a surface development substantially equal to the surface extension of the body 2. The reinforcement 12 can comprise, for example, a grid of metal material, particularly, a resistance-welded grid, exhibiting a varying thickness comprised, in a non limiting way, between 5 and 15 mm, particularly between 5 and 11 mm. The dimensions and the structure of the facing body 2 enable to define panels having a small weight, particularly less than 2000 kg, still more particularly less than 1800 kg.

As it is visible for example in FIGS. from 3 to 12, the containing element 1 comprises at least one monolithic reticular structure or grid 3 of plastic material partially integrated in the facing body 2. The reticular structure 3 exhibits a plurality of first elements 4 spaced from each other and extending along prevalent development paths, and a plurality of second elements 5 also spaced from each other extending along respective prevalent development paths in a direction substantially transversal to the first elements 4; the first and second elements 4, 5 intersect each other at respective nodes 6 in order to form meshes 7 (see FIGS. from 13 to 15, for example). Specifically, the reticular structure 3 substantially defines an integral reticular grid (in other words a monolithic grid obtained in one piece and not by connections such as by gluing or weaving different elongated elements) of plastic material comprising a series of first elements 4 parallel to each other; the first elements 4 are spaced from each other and interconnected by a plurality of second transversal elements 5, which are also parallel to each other. The elements 4 and 5 can be made of plastic materials selected as a function of their physical and mechanical characteristics; for example the elements 4 and 5 can be made of HDPE, PE, LDPE, PP, PVC, PS or of other polymers. In the present discussion, it is understood that each of the first elements 4 extends all along the width of the reticular structure 3, in other words is formed by the plurality of aligned portions along a same line transversal to the reticular structure 3. Similarly, each of the second elements 5 extends along the length of the reticular structure 3, in other words is formed by the plurality of portions aligned along a same longitudinal line of the reticular structure 3: in this way each of the first elements 4 is intersected by a plurality of the second elements 4 and each of the second elements 5 is intersected by a plurality of first elements 4. Advantageously the second elements 5 are stretched along their prevalent development direction (as it will be better described in the following, the second elements are stretched after being formed) and exhibit a structure having molecular chains oriented along such stretching directions. The stretching step provides the second elements 5 with an elongated shape capable of providing the reticular structure 3 with an optimal flexure strength, particularly enables the structure 3 to freely bend along at least one transversal axis substantially parallel to the first elements 4. Particularly, the second elements 5 exhibit a stretching ratio greater than 3, optionally comprised between 3 and 8, more optionally between 4 and 7; the stretching ratio of the second element 5 is defined as a ratio of a final length of the second elements 5 after being stretched (particularly immediately after being stretched) to an initial length of the second elements 5 before being stretched. Particularly, the term "before being stretched" means immediately after forming the reticular structure 3 (after forming a net defined by precursors of the first and second elements 4, 5) but before the stretching step.

FIGS. from 13 to 15 illustrate reticular structures 3 (grids) exhibiting second stretched elements 5. According to the stretching rate, the second elements 5 exhibit a more or less thin structure, so that they can take also a thread shape; anyway, the second elements 5 exhibit a cross-section that, at a median point between two first consecutive elements 4, is substantially smaller than the cross-section of said first elements 4. Each of these first and second elements 4, 5 exhibits portions extending between consecutive nodes 6. Further, due to the stretching step of the second elements 5, these latter exhibit portions—extending between consecutive nodes 6—having terminal areas having a section (measured normal to the main development direction of the second element 5) progressively decreasing from a node 6 towards a centre line of the portions, and a central area having a substantially constant cross-section.

Figure 13:
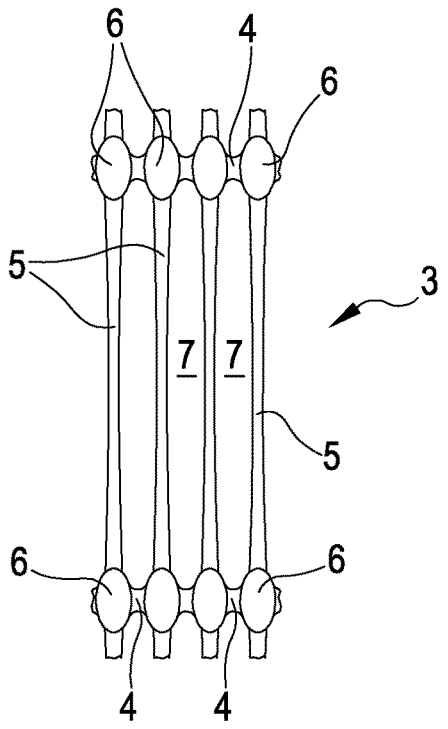
FIG. 13 is a schematic view of a portion of a monostretched reticular structure according to the present invention.

On the contrary, referring to the first elements 4, these latter, in a first embodiment shown for example in FIG. 13, exhibit, in a non limiting way, a substantially unstretched structure (or at most slightly stretched) and a thickness (and a cross-section) constantly greater than the thickness (and cross-section) of the second elements 5. In such configuration, the first elements 4 substantially define more compression-resistant bars capable of having more friction against the ground than the second elements 5. The first elements 4 are maintained unstretched for providing the containing element 1 a determined rigidity and a good capacity of being anchored to the ground.

Figure 14:
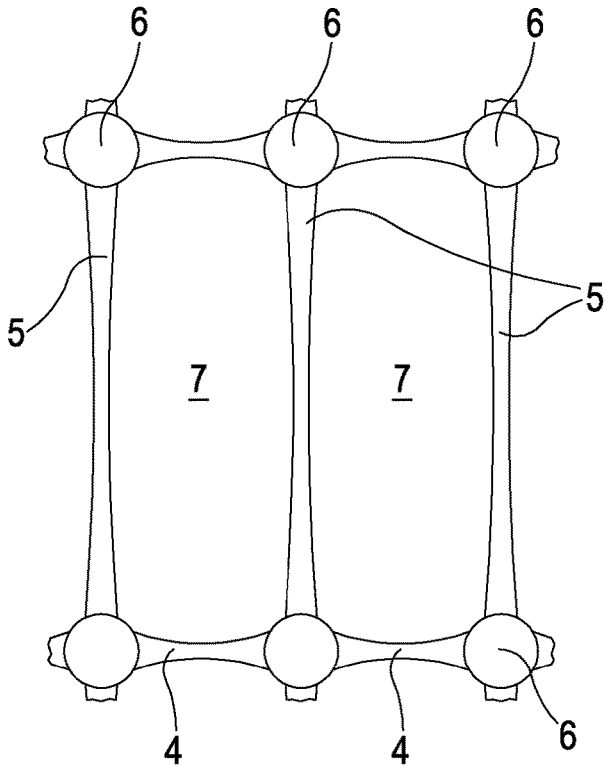
FIG. 14 is a schematic view of a portion of a bi-stretched reticular structure according to the present invention.
Figure 15:
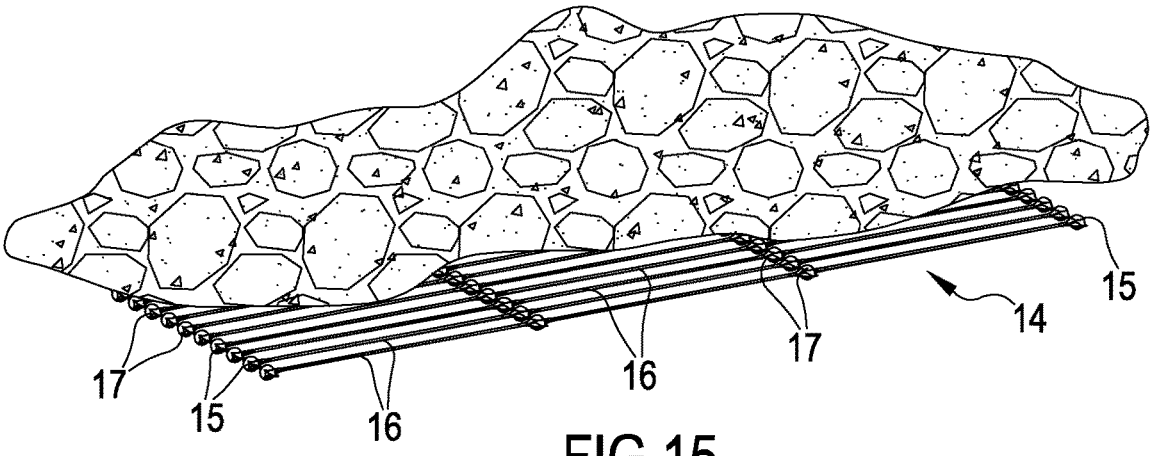
FIG. 15 is a schematic view showing a possible operative condition of a reinforcement net according to the present invention.
Figure 16:
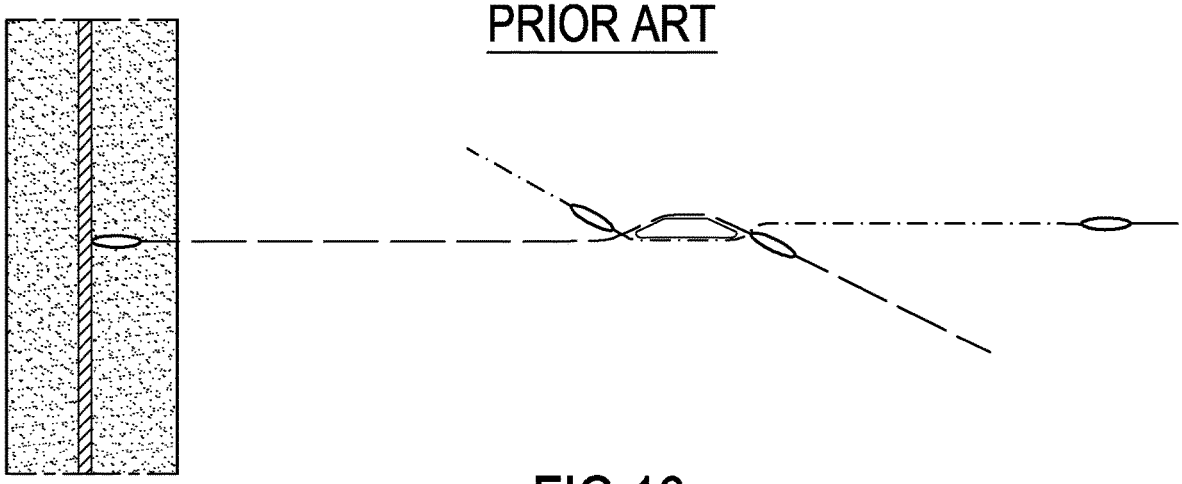
FIG.16 PRIOR ART
Figure 17:
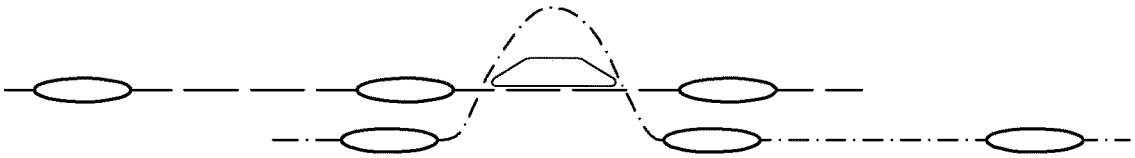
FIG.17 PRIOR ART
Figure 18:
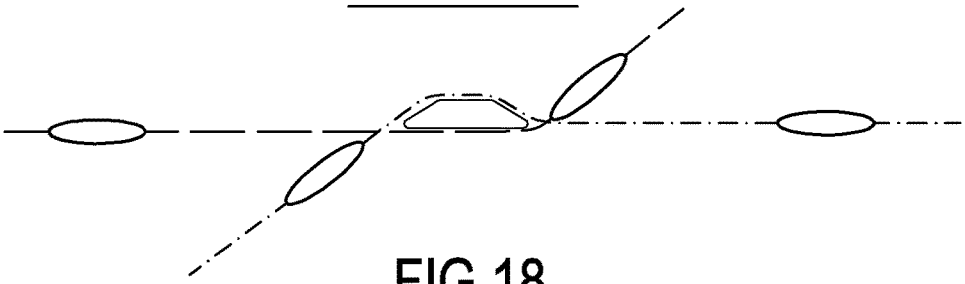
Figure 22:
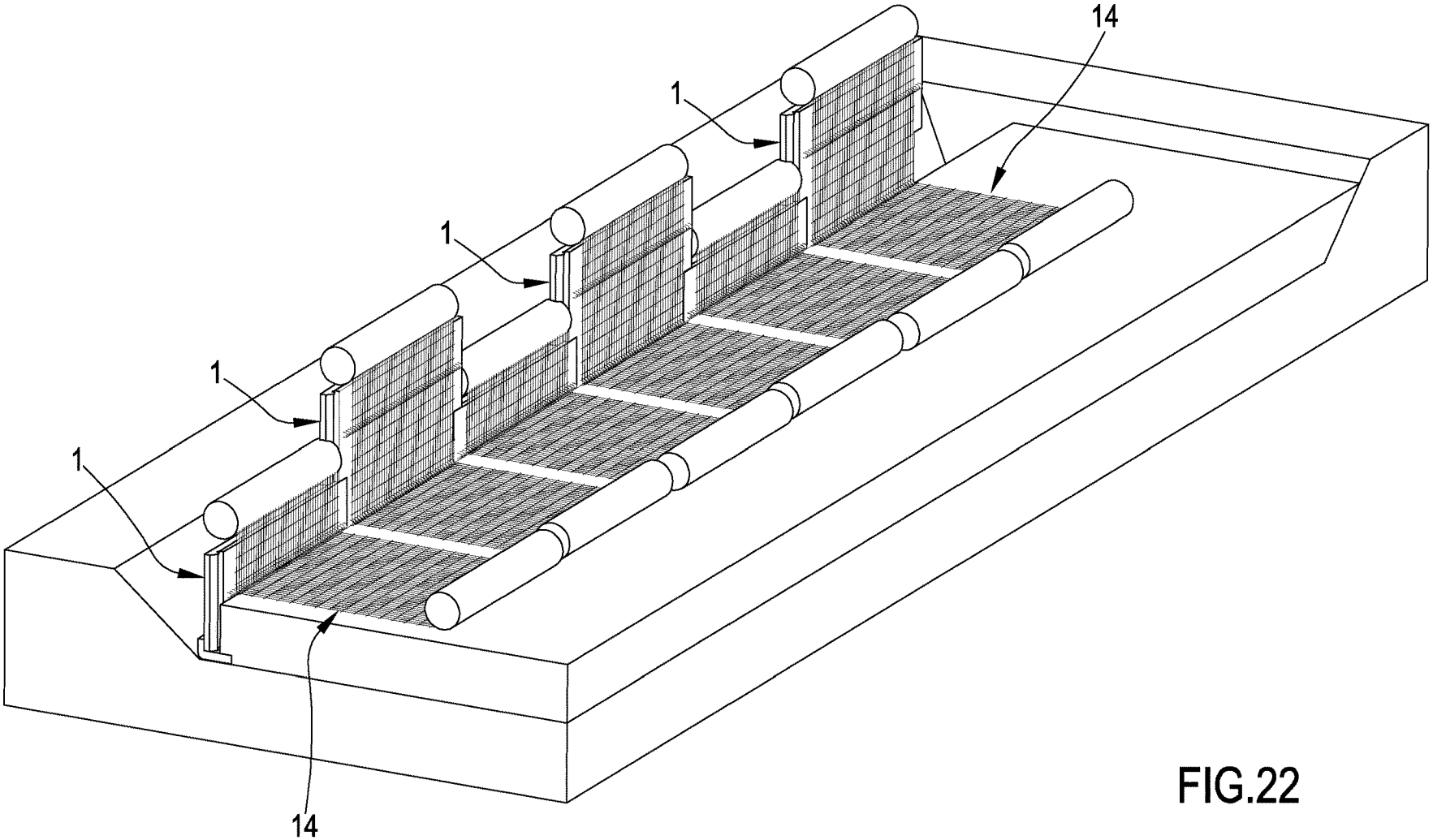

In a second embodiment illustrated in FIG. 14 for example, the first elements 4 are also stretched along their development in order to define in this way a bi-layered reticular structure. Despite the reticular structure 3 can exhibit a substantially bi-layered structure, it is anyway better to make different the stretch of the first and second elements. Particularly, the stretching ratio of the first elements 4 is at least half the stretching ratio of the second elements 5. In this way it is possible to obtain first elements 4 having an oriented molecular structure and therefore improved from the tensile strength level point of view, but having anyway a stiffer structure than the second elements 5. Particularly, it is preferable that first elements 4 maintain a determined rigidity and a determined bar-shape (not a thread shape) so that the same can ensure a determined grip (anchoring) to the ground. Therefore, in a preferred but non limiting embodiment of the invention, the first elements 4 are not stretched or are slightly stretched: for example, a stretch which does not cause a stretching ratio greater than 1.5, particularly about 1.25.

Now, the analysis of the reticular structure from the dimensional point of view makes possible to define the distances between the first and second elements. Specifically, the distance between two first adjacent elements 4 is comprised between 100 mm and 400 mm, optionally between 200 mm and 300 mm. The overall extension or length of each first element 4 of the reticular structure 3 is slightly less than the body 2 (panel) length and, particularly, greater than 0.5 m, specifically comprised between 0.7 and 2.5 m, still more particularly comprised between 1 and 2 m. The distance between adjacent second elements 5 is comprised between 10 mm and 50 mm, optionally between 15 mm and 30 mm. as these distances change, the dimensions of the meshes 7 change, which can exhibit a through area comprised between 1000 and 20000 $mm^2$.

Further, the first elements 4, according to a cross-section transversal to their prevalent development direction, exhibit an area greater than 15 $mm^2$, optionally greater than 30 $mm^2$. The second elements 5, according to a cross-section transversal to their prevalent development direction, exhibit an area greater than 3 $mm^2$, optionally greater than 4 $mm^2$. The second elements 5 are thinned by the stretching process by which a reduction of the cross-section area and a longitudinal elongation of the second elements 5 are obtained.

The reticular structure 3 exhibits also a determined size, or thickness S, normal to the first and second elements, providing the reticular structure 3 with a three-dimensional structure certainly different from the one of a sheet material. Particularly, the maximum thickness "S" of the reticular structure 3 is greater than 3 mm, for example 4 or 5 mm. The thickness "S" is defined by the maximum distance between opposite sides of the reticular structure 3.

The stretching process of the reticular structure 3 enables to improve the mechanical properties thereof, and particularly a greater tensile strength than the woven, metal or plastic unstretched geo-grids. Specifically, the reticular structure 3, as said before, is made of a plastic material, exhibits an areal mass (weight by surface unit) from 200 to 1200 $g/m^2$. With reference to the mechanical characteristics, the reticular structure 3 exhibits a specific tensile strength, along the stretched elements and, particularly, along the second elements 5, greater than 20 kN/m, particularly comprised between 20 and 250 kN/m, optionally between 60 and 200 kN/m. The specific tensile strength is measured by the method set out in the EN ISO 10319 standard. Another mechanical parameter characterizing the reticular structure 3 is the 2% elongation strength greater than 7 kN/m, particularly comprised between 10 and 100 kN/m, optionally between 10 and 70 kN/m.

Figure 12:
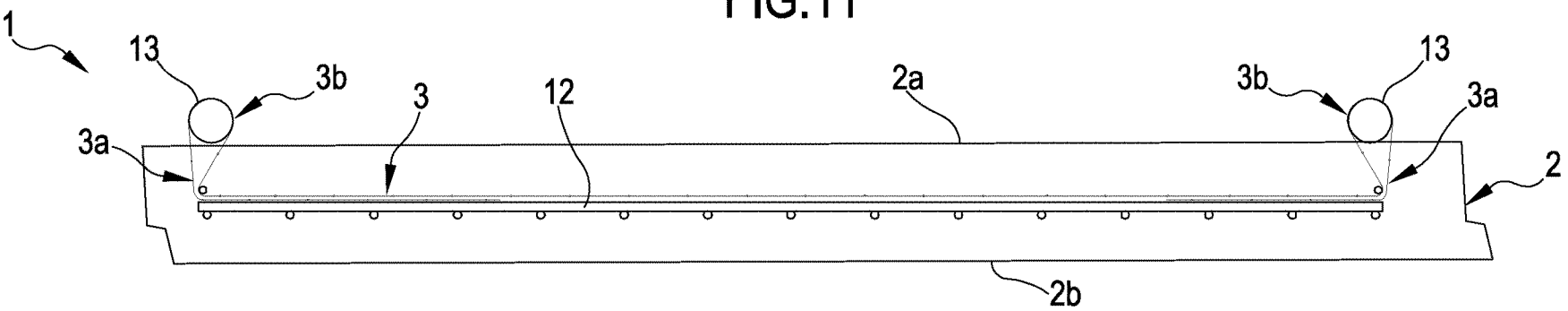
FIG. 12 is a lateral view a containing element, according to the present invention, according to an eighth embodiment.
Figure 12A:
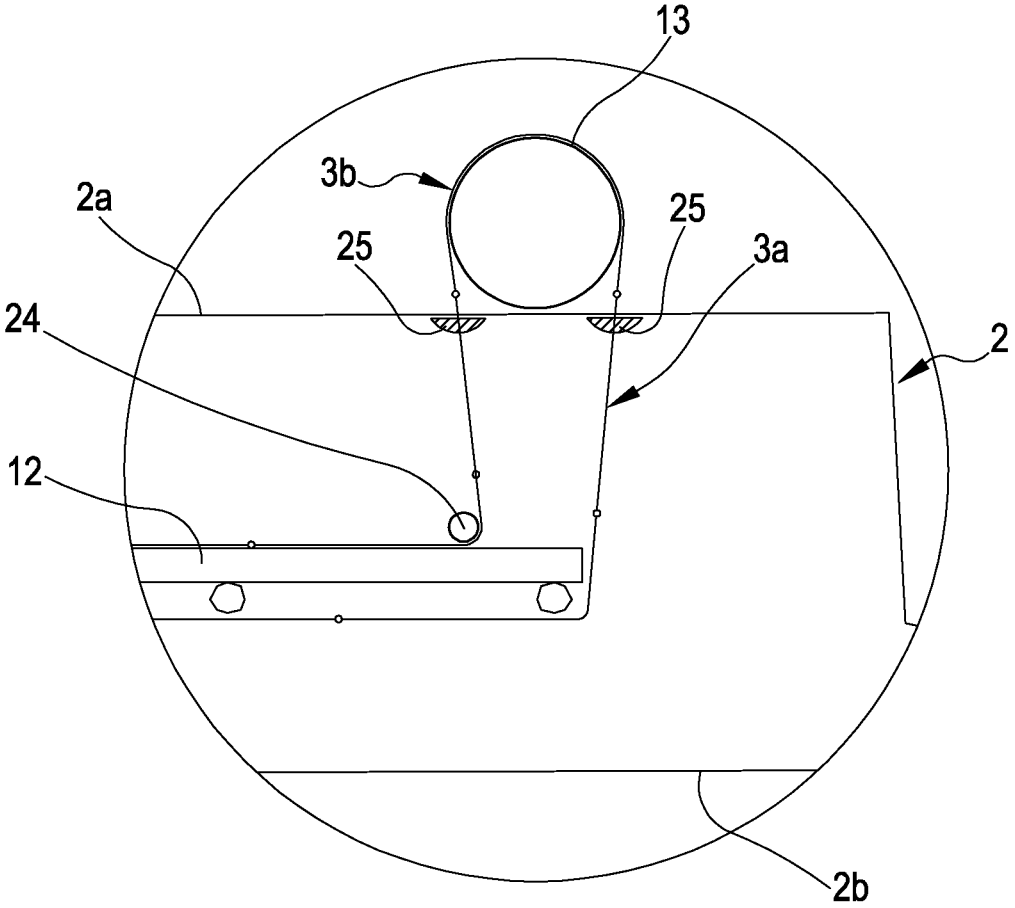
FIG. 12A is detailed cross-section view of a variant of an embodiment of a containing element according to the present invention.

As hereinbefore briefly described, the reticular structure 3 is partially integrated inside the facing body 2. Particularly, as it is visible in the attached figured, the reticular structure 3 comprises at least one first portion 3*a* integrated and stably embedded in the facing body 2 and one second portion 3*b* integrally joined to the first portion 3*a*, emerging from the inner face 2*a* of the facing body 2. The first portion 3*a* of the reticular structure 3 comprises a first and second flaps 8, 9 (FIG. 3A) spaced from each other and ending at the inner face 2*a* of the facing body 2. The second portion 3*b* of the reticular structure 3 exhibits also a first and second flaps 10, 11 (FIG. 3A) spaced from each other and integrally joined to the respective first and second flaps 8, 9 of the first portion 3*a* of the reticular structure 3. As it is visible in FIG. 12A for example, the containing body 2 can incorporate shielding elements 25, of plastic or rubber material, placed at the inner face 2*a*; the shielding elements 25 are configured for at least partially wrapping the first and second flaps 8, 9 of the reticular structure 3 for preventing this latter to be damaged due to the movements of the second portion 3*b*.

Figure 2:
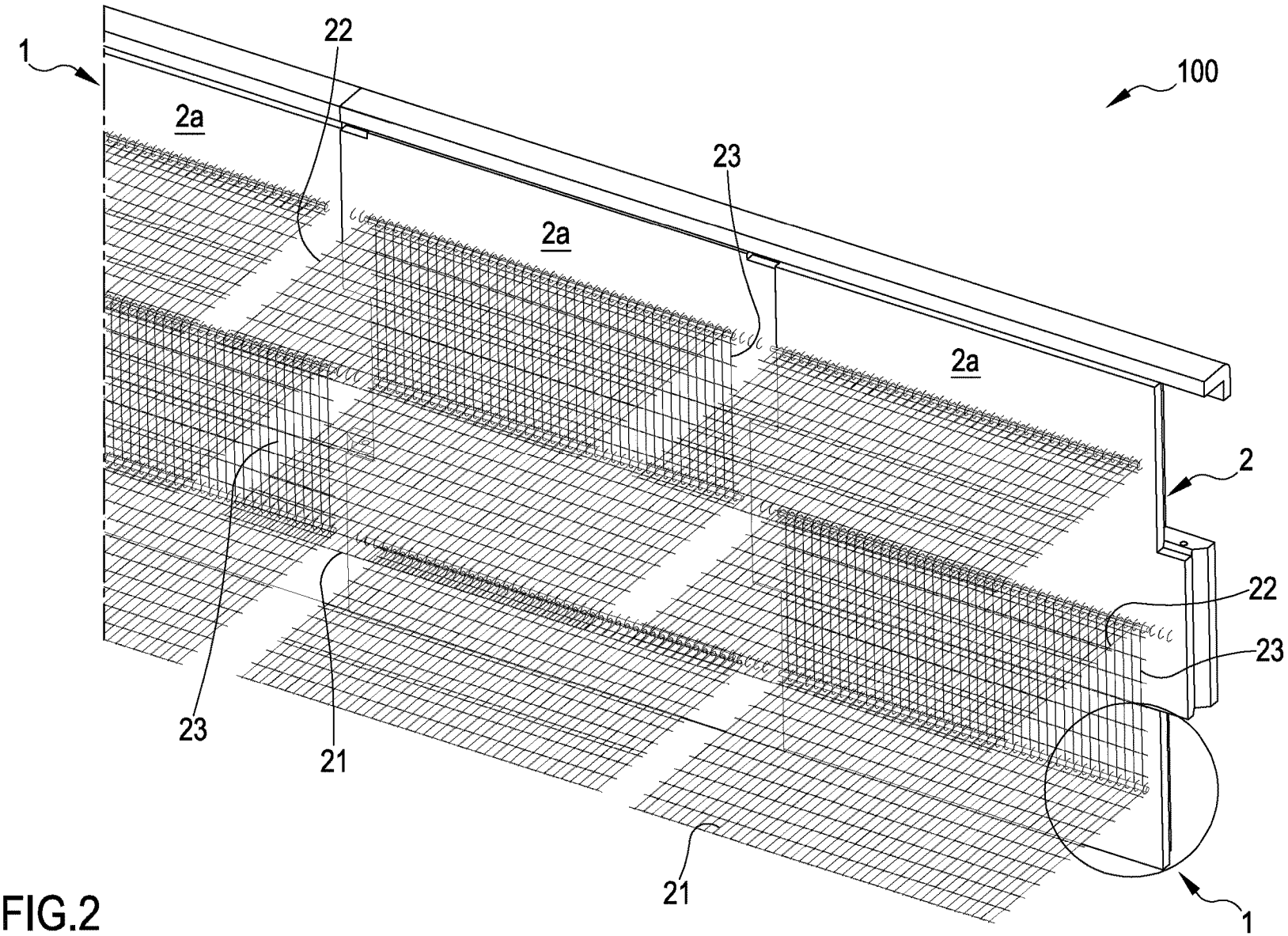
Figure 6:
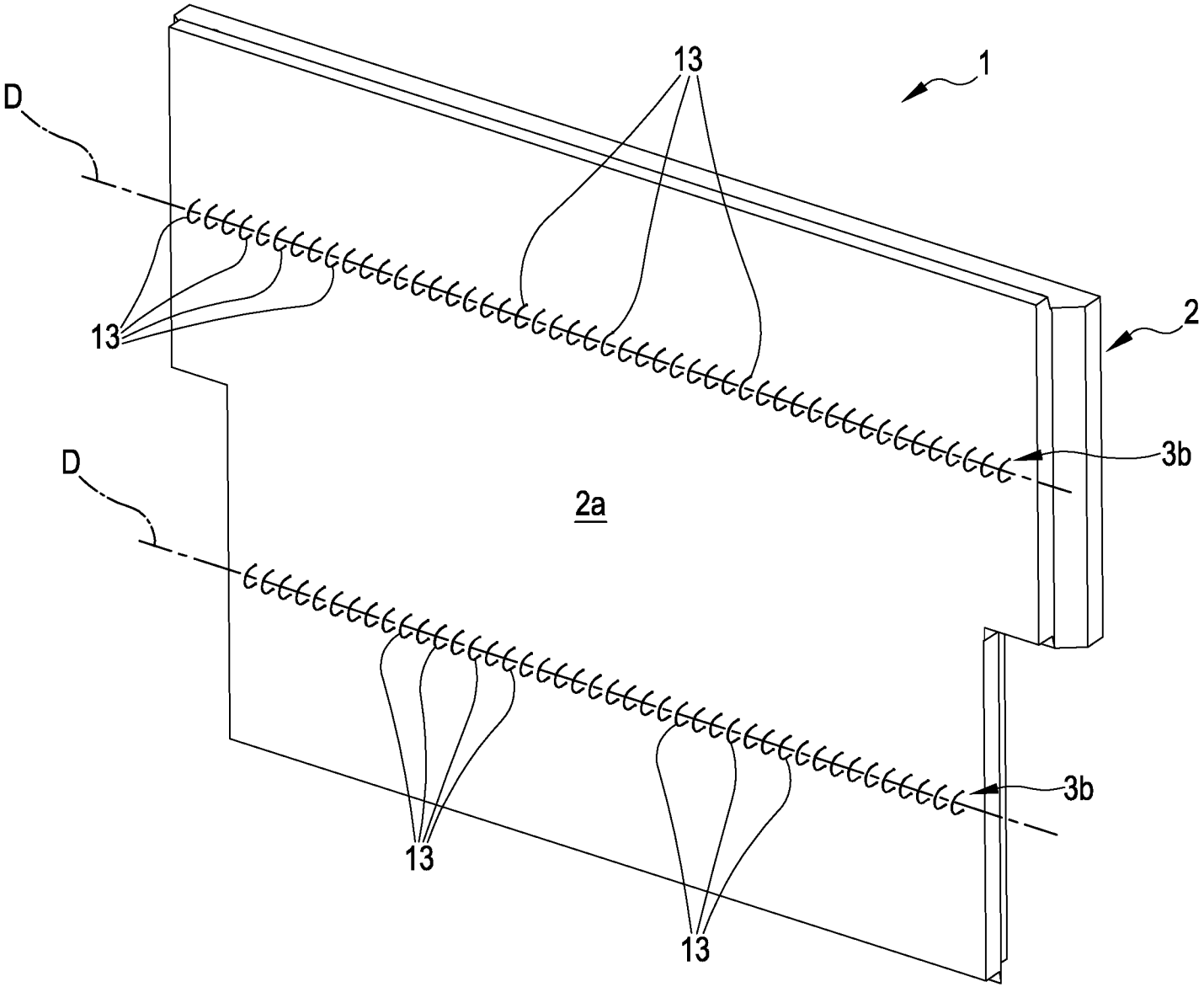
FIG. 6 is a perspective view of a containing element according to the present invention.

The second portion 3*b* of the reticular structure 3 defines a plurality of slots 13, each of them, cooperatively with the inner face 2*a* of the containing body 2, substantially defines a closed outline loop. The plurality of slots 13 of the second portion 3*b* of the reticular structure 3 are aligned along a predetermined rectilinear direction D, for example parallel to a prevalent development plane of the facing body 2. Particularly, in an operative condition of the containing element, the direction D aligning the plurality of slots 13 is substantially horizontal (FIG. 2). The attached figures illustrate, in a non limiting way, the containing elements 1 provided with second portions 3*b* emerging from the facing body 2: each portion defines a plurality of slots 13. Therefore, there are, on each panel, two pluralities of slots 13 and therefore two closed loops (see FIGS. 3, 4 and 6 for example). As it is visible from the cross-section views in FIGS. 3, 4, 7-12, the reticular structure 3 comprises a single net or geo-grid folded inside the facing body 2 and exhibiting—for the same net—two second portions 3*b*. In such condition, the reticular structure 3 extends along the facing body 2 between the different portions 3*b*.

Figure 3:
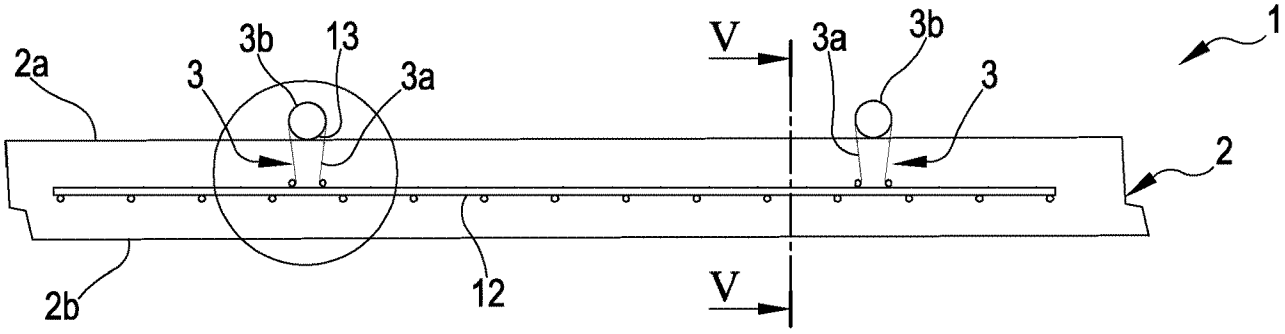
FIG. 3 is a lateral view of a containing element, according to the present invention, according to a first embodiment.
Figure 4:
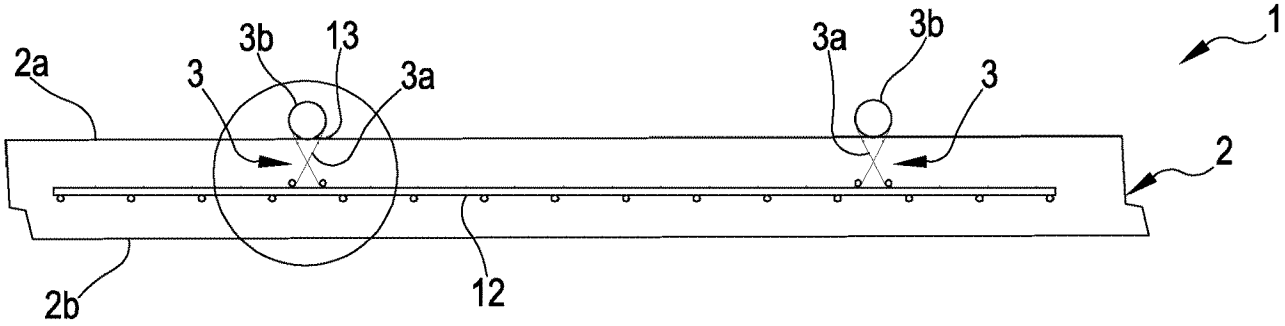
FIG. 4 is a lateral view of a containing element, according to the present invention, according to a second embodiment.
Figure 5:
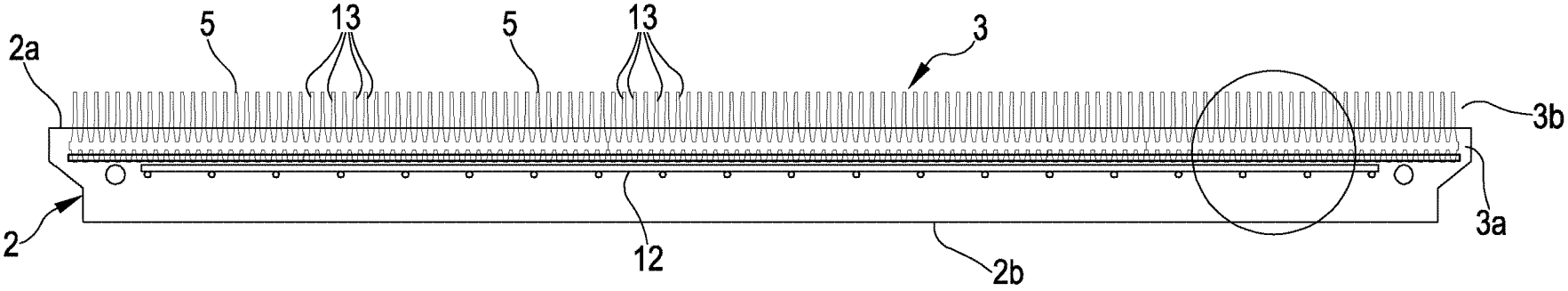
FIG. 5 is a top view of a containing element according to the present invention.
Figure 3A:
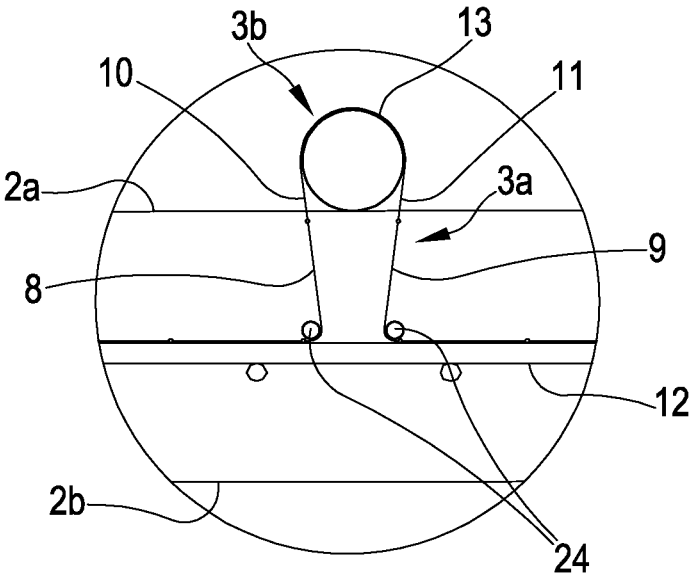
FIG. 3A is a detail of the containing element in FIG. 3.
Figure 4A:
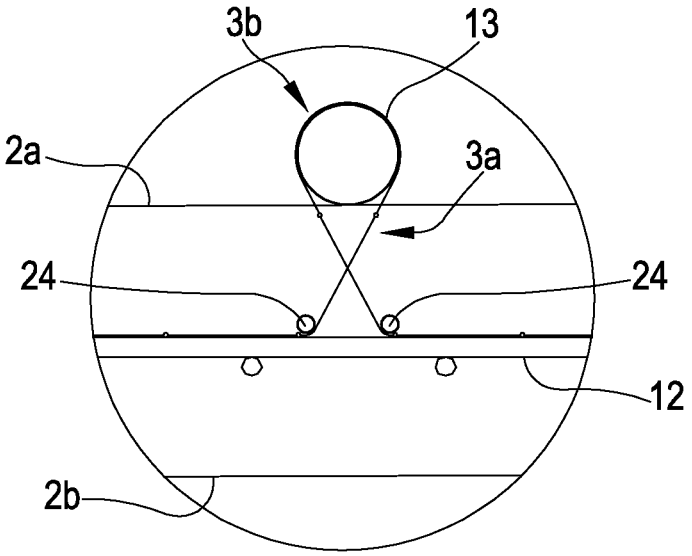
FIG. 4A is a detail of the containing element of FIG. 4.
Figure 4B:
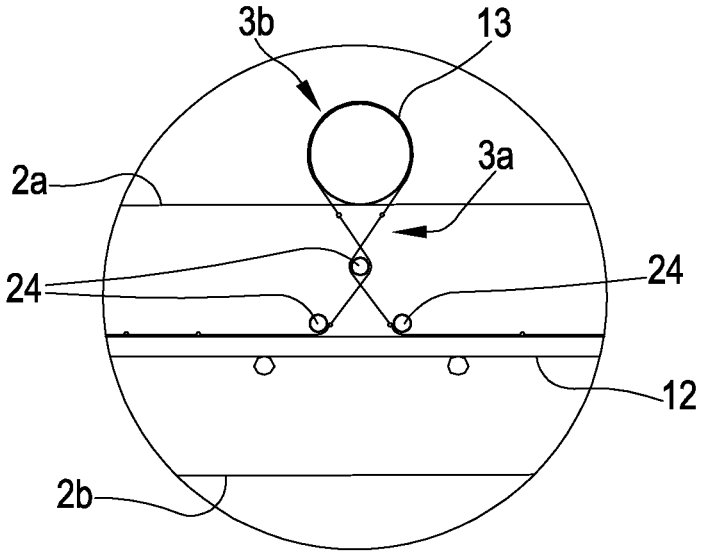
FIG. 4B is a detail of a containing element according to the present invention.
Figure 5A:
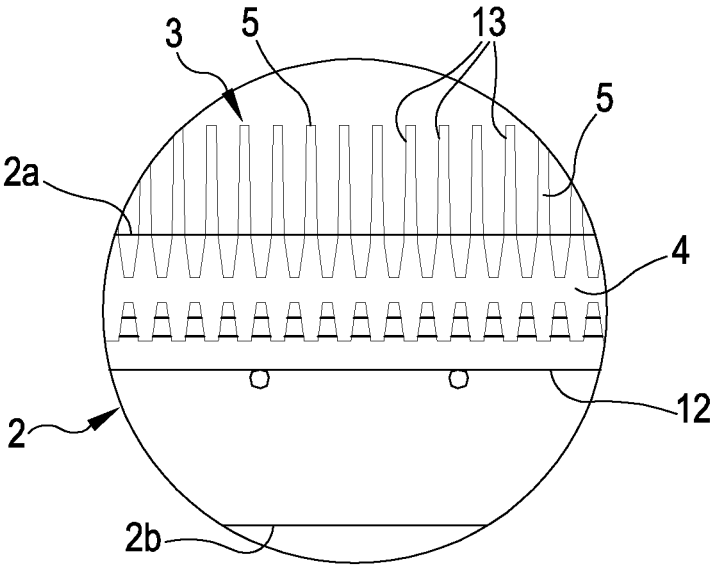
FIG. 5A is a detail of the containing element in FIG. 5.
Figure 7:
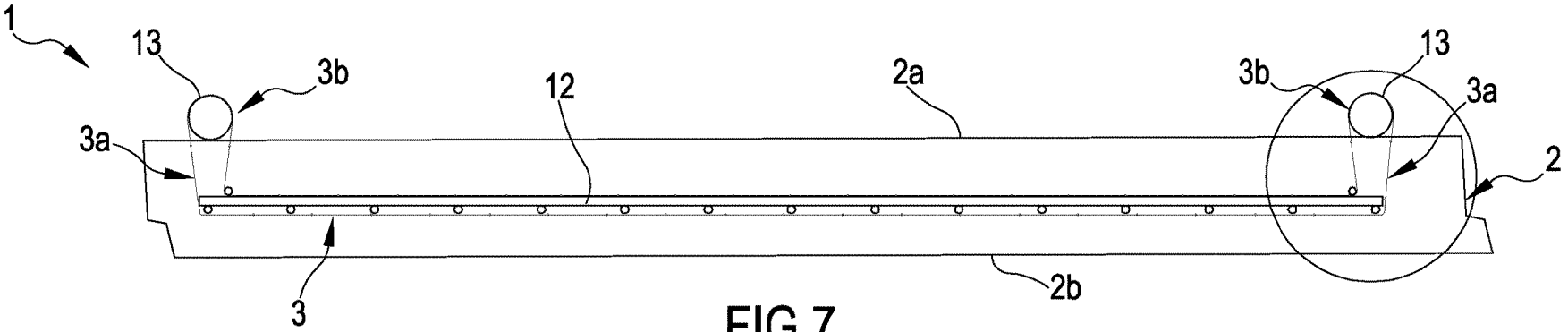
FIG. 7 is a lateral view of a containing element, according to the present invention, according to a third embodiment.
Figure 8:
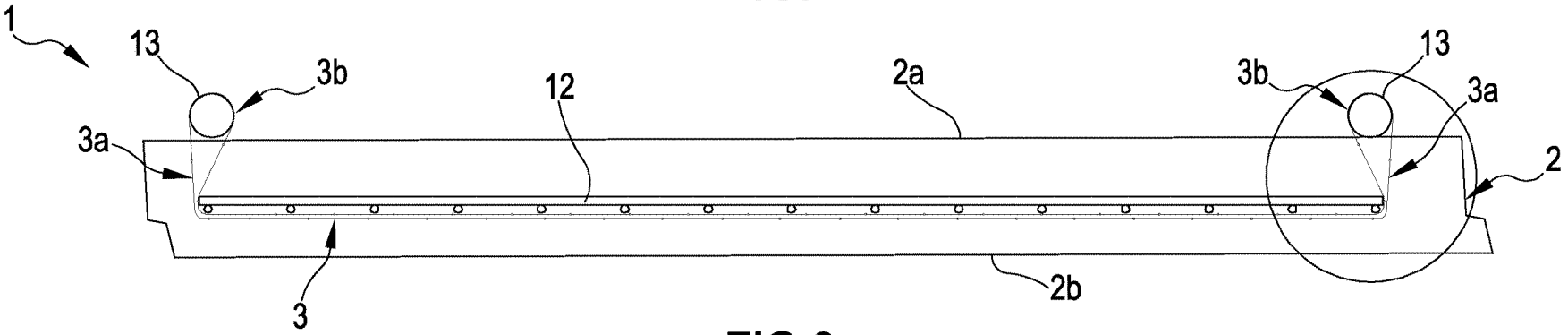
FIG. 8 is a lateral view a containing element, according to the present invention, according to a fourth embodiment.
Figure 9:
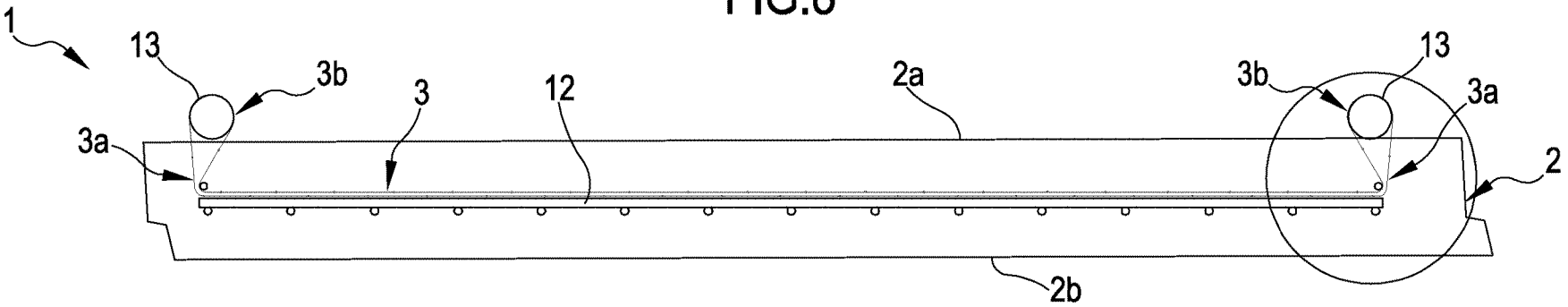
FIG. 9 is a lateral view a containing element, according to the present invention, according to a fifth embodiment.
Figure 7A:
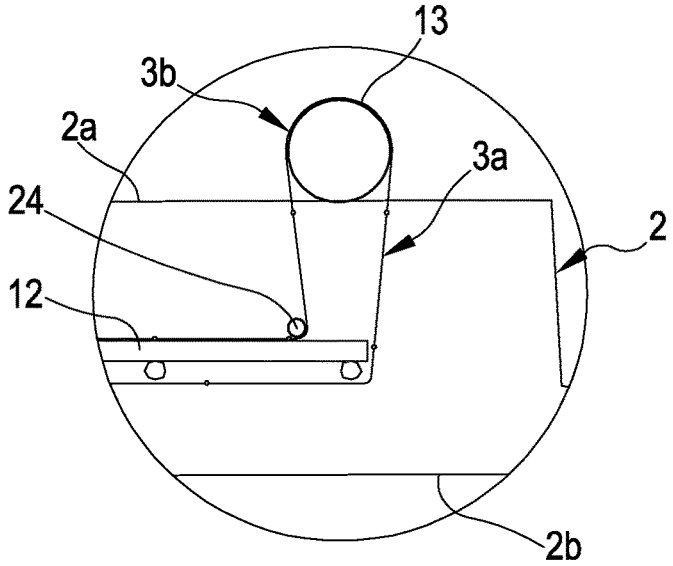
FIG. 7A is a detail of the containing element in FIG. 7.
Figure 8A:
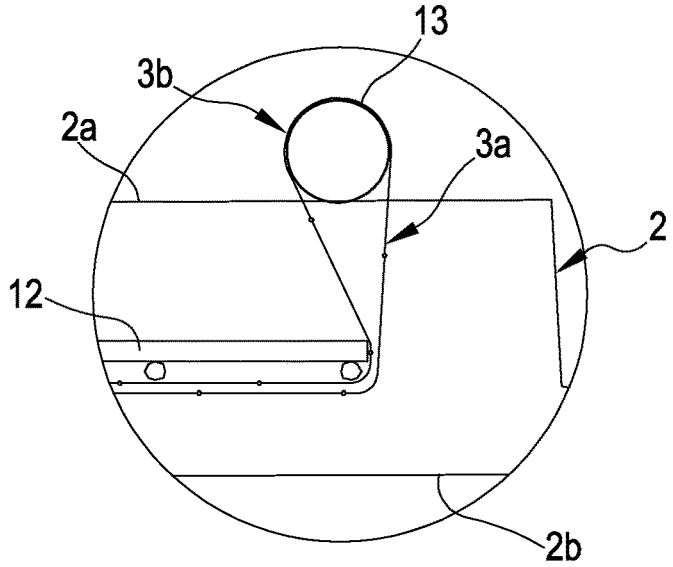
FIG. 8A is a detail of the containing element in FIG. 8.
Figure 9A:
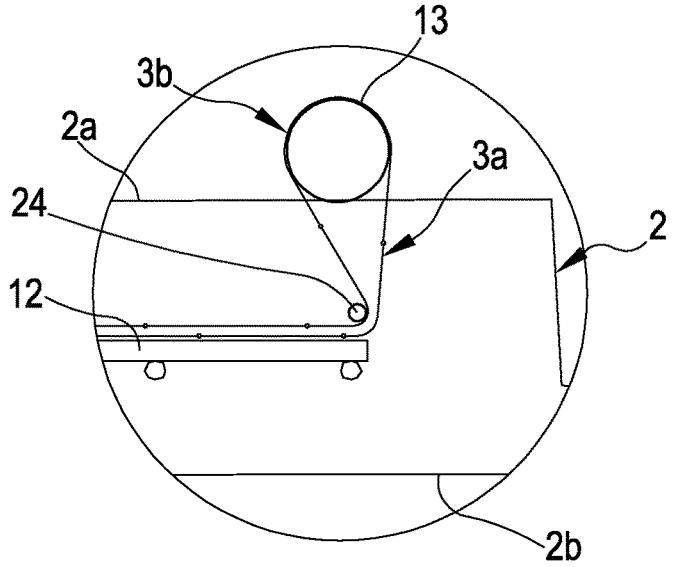
FIG. 9A is a detail of the containing element in FIG. 9.
Figure 10:
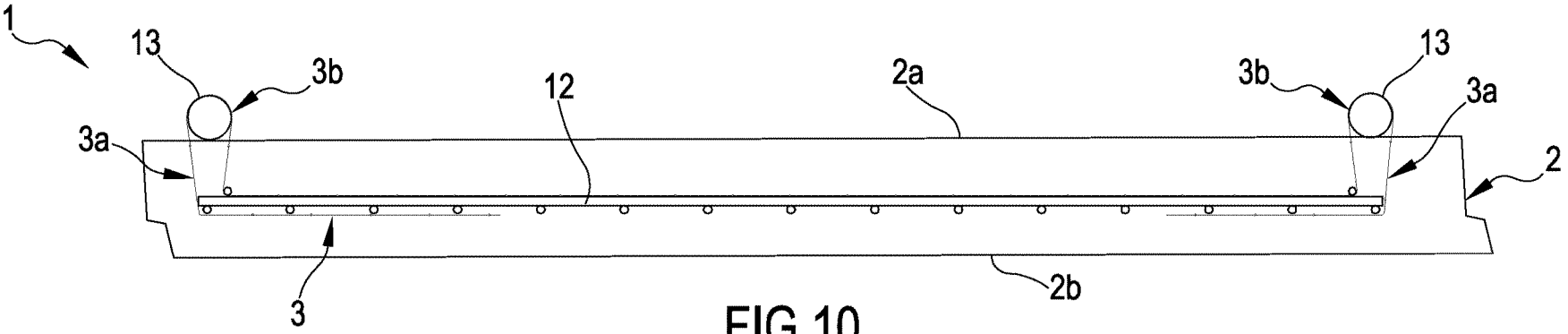
FIG. 10 is a lateral view a containing element, according to the present invention, according to a sixth embodiment.
Figure 11:
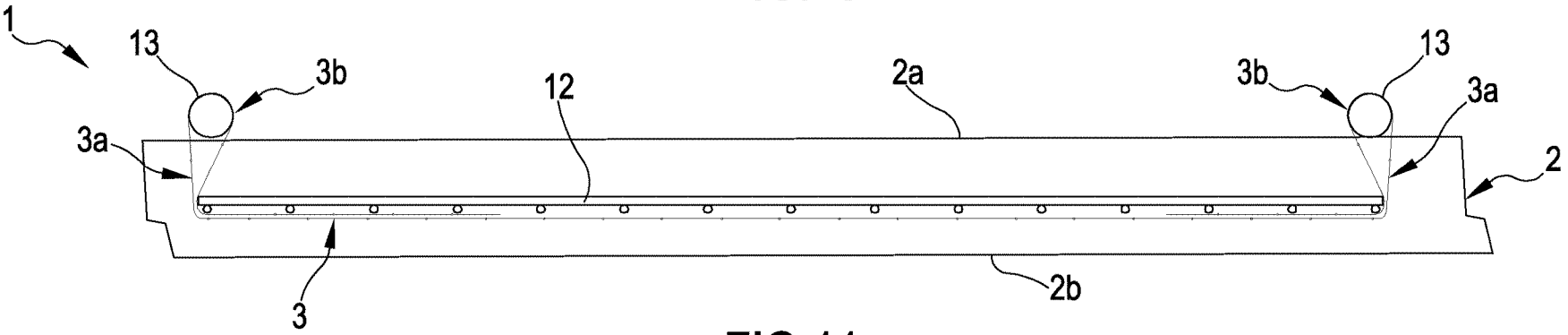
FIG. 11 is a lateral view of a containing element, according to the present invention, according to a seventh embodiment.

More particularly, FIGS. 3 and 4 illustrate a configuration of the reticular structure 3 positioned in the body 2 according to only one layer, particularly engaged above the reinforcement 12. FIG. 7 illustrates another configuration of the element 1 wherein the reticular structure 3 is placed in the body 2 along two layers: a first layer arranged between the reinforcement and the inner face 2*a* and a second layer arranged between the reinforcement 12 and the outer face 2*b*. De facto, in the configuration of FIG. 7, the reinforcement 12 is interposed between the first and second layers of the reticular structure 3. Instead, FIG. 8 illustrates a configuration of the containing element 1 wherein the reticular structure 3 exhibits two layers integrated in the body 2, both interposed between the reinforcement 12 and the outer face 2*b*. On the contrary, in FIG. 9, the reticular structure 3 is always present inside the body 2 always as a double layer but interposed between the reinforcement 12 and the inner face 2*a* of the body 2. Instead, FIGS. from 10 to 12 illustrate several configurations of the reticular structure 3, present inside the body 2 with a first layer developing between the portions 3*b* and a second layer developing only for a segment of the body 2. As it is specifically visible in FIGS. 3A, 4A, 7A and 9A, the reticular structure 3 in a non limiting way, is fixed also to the reinforcement 12 by means of anchoring elements 24. De facto, these elements are used during the step of making the body 2, for stably anchoring the reticular structure 3 to the reinforcement 12 (the structure and function of the anchoring elements 24 will be fully described in the following during the description of the process of making the containing element 1). Obviously, it is possible to provide on each facing body 2, just one plurality of slots 13 (only one loop) or a number of second portions 3*b* emerging from the body 2 greater than two (these conditions are not shown in the accompanying figures). Moreover, in a further variant of the embodiment not illustrated in the accompanying figures, it is present a single and distinct reticular structure 3 defining only one first portion 3*a* and only one portion 3*b*. In such configuration, the presence of two or more portions 3*a*, 3*b* is determined by the presence of two or more reticular structures 3 distinct from each other.

Now, by analyzing the structure of each single slot 13, it is possible to observe (FIG. 6) that this latter exhibits a substantially "C" or "U" shape having a concavity facing the inner face 2*a* of the facing body 2; particularly, each slot 13 of the second portion 3*b* of the reticular structure 3 is integral with the facing body 2 and defines, with the inner face 2*a* of this latter, a closed loop. As hereinbefore described, the reticular structure 3 comprises the first and second elements 4, 5 (optionally is only formed by said first and second elements). The first elements 4 extend along respective prevalent development directions parallel to the direction D aligning the slots 13, particularly parallel to the prevalent development plane (extension plane) of the facing body 2. Viceversa, at least the second elements 5 of the second portion 3*b* of the reticular structure 3 extend along arc-shaped paths transversal to the prevalent development plane of the facing body 2. De facto, the second elements 5 of the reticular structure 3 exhibit paths transversal—optionally normal—to the direction D aligning the slots 13, but only the second elements 5 of the second portion 3*b* exhibit paths transversal to the development plane (extension) of the facing body 2. The second portion 3*b* of the reticular structure 3 comprises at least one plurality of second elements 5 emerging from the inner face 2*a* of the facing body 2, each of them defines a slot 13: the plurality of second elements 5 is aligned along the predetermined rectilinear direction D parallel to the prevalent development plane of the facing body 2 itself. The second portion 3*b* can comprise first and second elements 4, 5 (FIG. 12A) or can be only formed by second elements 5; in this latter case, the second portion 3*b* of the reticular structure 3 is devoid of the first elements 4 which are all completely embedded in the facing body 2. From the dimensional point of view, the slots 13 of a same plurality (slots aligned along a same direction D) are positioned at a distance present between second elements 5; particularly, two consecutive slots 13 along the same direction D exhibit a minimum distance from each other—the distance measured along the same direction D—less than 60 mm, particularly comprised between 10 and 50 mm, still more particularly comprised between 15 and 30 mm. The plurality of slots 13 therefore defines, along the predetermined direction D, a type of channel longitudinally delimited by opposite terminal slots 13: the channel exhibits a defined length from the measured maximum distance between said opposite terminal slots 13, greater than 0.5 m, particularly comprised between 0.7 and 2 m. In other words, the second portion 3*b* of the reticular structure 3 comprises, for each linear meter measured along the predetermined direction D, a number of slots 13 (and therefore of second elements 5) greater than 10, particularly comprised between 20 and 100, still more particularly comprised between 30 and 70. Generally, for each facing body 2, there are a number of slots 13 aligned along one single direction D greater than 20, particularly comprised between 50 and 300. More particularly, each single element 5, defining the second portion 3*b* of the reticular structure 3, defines a slot 13 the perimetral extension thereof is comprised between 50 and 500 mm, particularly between 80 and 300 mm (the perimetral extension of the slot between the first and second flaps 10, 11). In other words, each closed outline loop, defined by the cooperation of a slot 13 and the inner face 2*b* of the facing body 2, defines a passage inner area comprised between 8 and 800 $cm^2$, particularly comprised between 20 and 300 $cm^2$.

Reinforced Ground Structure

Further, it is an object of the present invention a reinforcement structure 100, particularly used for defining vertically extending supporting faces and/or walls. As it is visible in FIG. 1, the structure 100 comprises a plurality of containing elements 1 according to the present invention. The plurality of containing elements 1, in an operative condition of the structure 100, is vertically positioned by overlapped rows; particularly, there are a plurality of horizontal rows and a plurality of columns of side-by-side containing elements 1 in order to define substantially a wall containing the ground. Each of said containing element 1 exhibits at least one second portion 3*a* of the reticular structure 3 emerging from the inner face 2*a* of the facing body 2 in order to define a plurality of slots 13. More particularly, all the containing elements 1 exhibit second portions 3*b* emerging from the same side of the structure 100 (of the wall): all the containing elements 1 exhibit the second portions 3*b* emerging towards the ground to be reinforced and contained.

As it is for example visible in FIGS. 1 and 2, the structure 100 comprises a predetermined number of reinforcement nets or geo-grids 14, each of them exhibits a monolithic structure of plastic material. In a preferred but non limiting embodiment of the invention, the net 14 exhibits substantially the same structure as the geo-grids 14. Particularly, the first elements 4 of the reticular structure 3 are substantially identical to the first elements 15 of the net 14, while the second elements 5 of the reticular structure are substantially identical to the second elements 16 of the net 14.

Figure 2A:
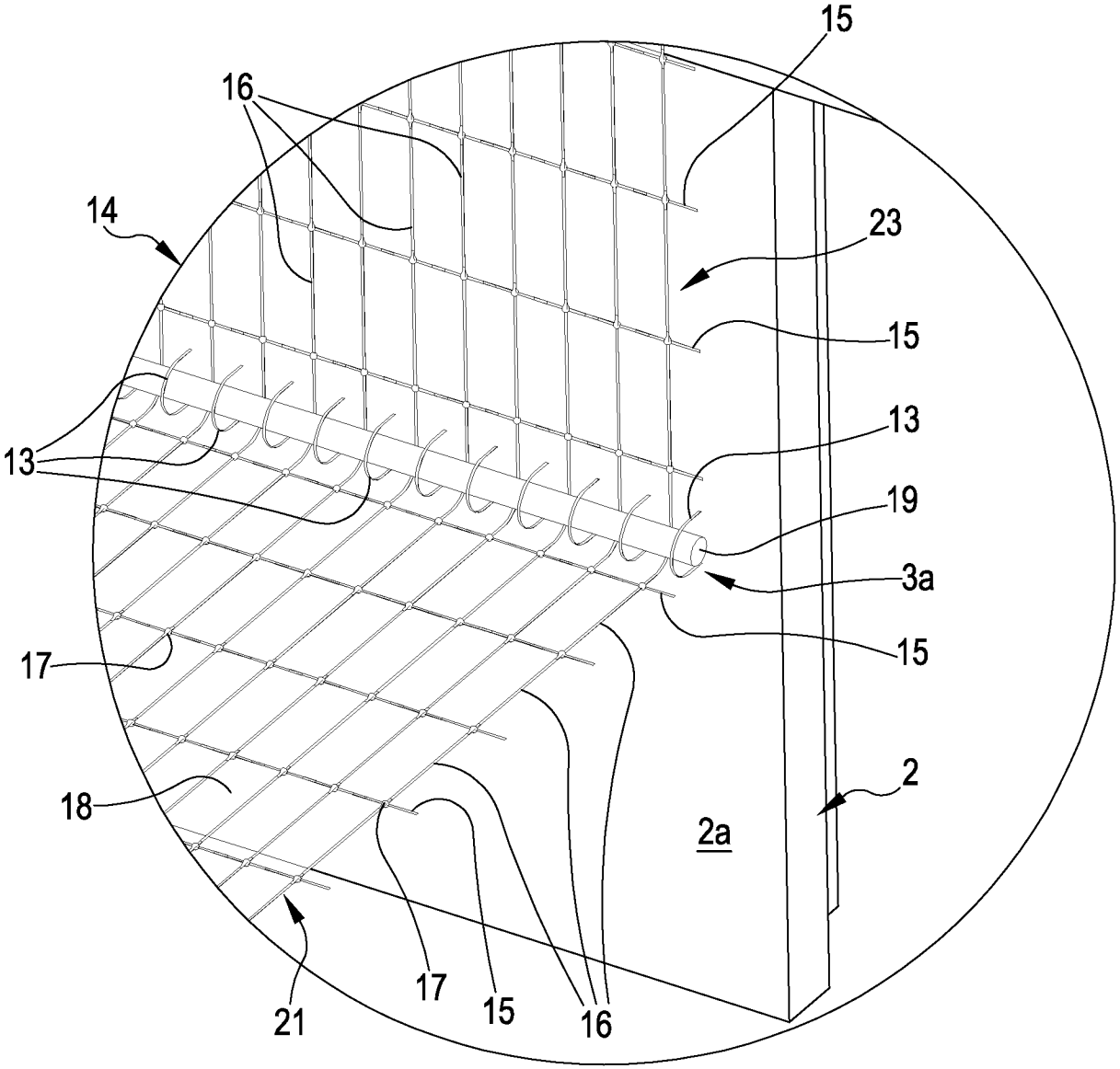

Particularly, as it is visible in FIG. 2A, the net 14 also comprises a plurality of first elements 15 spaced from each other and developing along prevalent development paths and a plurality of second elements 16 also spaced from each other, which extend along respective prevalent development paths in a direction substantially transversal to the first elements 15; the first and second elements 15, 16 intersect each other at respective nodes 17 in order to form meshes 18. Specifically, the reinforcement net 14 substantially defines an integral reticular grid (in other words a monolithic grid integrally obtained and not made of connections obtained by gluing or weaving different elongated elements) of plastic material, comprising a series of first elements 15 parallel to each other; the first elements 15 are spaced from each other and interconnected by a plurality of second transversal elements 16, which are also for example parallel to each other. The elements 15 and 16 can be made of plastic materials selected on their physical and mechanical properties; for example, the elements 15 and 16 can be made of HDPE, PE, LDPE, PP, PVC, PS or other polymers.

In the present discussion, it is understood that each of the first elements 15 extends along all the width of the net 14, in other words is formed by the plurality of portions aligned along a same line transversal to the reinforcement net 14. Similarly, each of the second elements 16 extends in the direction of the net 14 length, in other words is formed by the plurality of portions aligned along a same longitudinal line of the net 14: in this way, each of the first elements 15 is intersected by a plurality of second elements 16, while each of the second elements 16 is intersected by a plurality of first elements 15.

Advantageously, the second elements 16 are stretched along their prevalent development direction (as it will be better described in the following, the second elements 16 are stretched after being formed) and exhibit a structure having molecular chains oriented along such stretching direction. The stretching action provides the second elements 16 with an elongated shape which consequently is capable of providing the net 14 with an optimal flexural strength, particularly enables the net 14 to freely bend along at least one axis transversal, substantially parallel, to the first elements 15.

Particularly, the second elements 16 exhibit a stretching ratio greater than 3, optionally comprised between 3 and 8, more optionally between 4 and 7; the stretching ratio of the second elements 15 is defined as a ratio of a final length of the second elements 15 after being stretched, to an initial length of the second elements 15 before being stretched (in other words after forming the reticular structure 3 but before stretching it). According to the stretching rate, the second elements 16 exhibit a more or less thin structure, which enables also to have a thread-like shape; anyway, the second elements 15 exhibit a cross-section which, at a median point between two first consecutive elements 15, is substantially less than the cross-section of said first elements 15.

Each of these first and second elements 15, 16 exhibit portions extending between consecutive nodes 17. Moreover, due to the stretching step of the second element 16, these latter exhibit portions—extending between consecutive nodes 17—having terminal areas of a cross-section (measured normal to the main development direction of the second elements 16) progressively decreasing from a node 17 towards a centre line of the portions, and a central area having a substantially constant cross-section. On the contrary, with reference to the first elements 15, these latter, in a first embodiment, exhibit, in a non limiting way, a substantially unstretched structure (or at most slightly stretched) and a thickness (and a cross-section) constantly greater than the thickness (and than the cross-section) of the second elements 16. In such configuration, the first elements 15 substantially define more compression-resistant bars capable of having a greater friction against the ground than the second elements 16. The first elements are maintained unstretched because the net 14 must have a determined stiffness and a good ground anchoring capacity.

In a second embodiment, the first elements 15 are also stretched along their development in order to define in this way a bi-layered reticular structure. Despite the reticular structure can exhibit a substantially bi-layered structure, it is anyway preferable to make different the stretch of the first and second elements. Particularly, the stretching ratio of the first elements 15 is at least half the stretching ratio of the second elements 16. In this way it is possible to obtain first elements having an oriented molecular structure and therefore improved from a tensile strength point of view but anyway having a stiffer structure than the second elements 16. Specifically, it is preferable the first elements 15 maintain a determined stiffness and a determined bar shape (not a thread-like shape) so that the same can provide a determined grip (anchoring) with the ground. Therefore, in a preferred but non limiting embodiment of the invention, the first elements 15 are not stretched or are slightly stretched: for example, they are stretched so that the stretching ratio is not greater than 1.5, particularly is about 1.25.

Now, by specifically analyzing the net 14 structure from the dimensional point of view, it is possible to define the distances between the first and second elements 15, 16. Particularly, the distance between two first adjacent elements 15 is comprised between 100 mm and 400 mm, optionally between 200 mm and 300 mm. The overall length of each first element 15 of the net 14 is slightly smaller than the body 2 (panel) length and is particularly greater than 0.5 m, specifically comprised between 0.7 and 2.5 m, still more particularly comprised between 0.7 and 2 m. The distance between second adjacent elements 16 is comprised between 10 mm and 50 mm, optionally between 20 mm and 40 mm. As this distance changes, also the dimensions of the meshes 18 change, which can exhibit a through area comprised between 1000 and 20000 $mm^2$. Further, the first elements 15, according to a cross-section transversal to their prevalent development direction, exhibit an area greater than 15 $mm^2$, optionally greater than 30 $mm^2$. The second elements 16, along a cross-section transversal to their prevalent development direction, exhibit an area greater than 3 $mm^2$, optionally greater than 4 $mm^2$. The second elements 16 are thinned by the stretching process by which it is obtained a reduction of the cross-section area and a longitudinal elongation of the second elements 16. The net 14 exhibits also a determined size, or thickness S, normal to the first and second elements, providing the net 14 with a three-dimensional structure definitely different from the sheet materials. Particularly, the maximum thickness "S" of the net 14 is greater than 3 mm, for example 4 or 5 mm. The thickness "S" is defined by the maximum distance between opposite sides of the net 14. The net 14 stretching process enables to improve the mechanical properties, and particularly a better tensile strength than the woven, metallic, or plastic unstretched geo-grids. Specifically, the net 14, as hereinbefore said, is made of a plastic material, exhibits an areal mass (weight by surface unit) from 200 to 1200 $g/m^2$. With reference to the mechanical properties, the net 14 exhibits a specific tensile strength, along the stretched elements and particularly along the second elements 16, greater than 20 kN/m, particularly comprised between 20 and 250 kN/m, optionally between 60 and 200 kN/m. The specific tensile strength is measured by the method set out in the EN ISO 10319 standard. Another mechanical parameter characterizing the net 14 is the 2% elongation strength, greater than 7 kN/m, particularly comprised between 10 and 100 kN/m, optionally between 10 and 70 kN/m.

As it is for example visible in FIG. 2A, the net 14 is engaged at least with a plurality of slots 14 aligned along the same direction D; particularly, at least a series of second elements 16 of said net 14, comprised between two first adjacent immediately consecutive elements 15, are inserted and interwoven with a plurality of slots 13 of the containing element 1 in order to form with these latter a closed loop. Further, the structure 100 comprises at least one locking bar 19 (FIG. 2A) engaged inside the plurality of slots 13 so that the series of second elements 16 of the net 14 is interposed between the facing body 2 and locking bar 19: the locking bar 19 is configured for stably constraining the facing net 14 to the containing element 1. Specifically and as it is visible in FIG. 2, each containing element 1 exhibiting at least one second portion 3*b* emerging from the body 2 and therefore defining at least one plurality of slots 13, is constrained to a reinforcement net 14: the net 14 extends from the facing body 2 inside the ground for defining a type of reinforcement for the same and therefore for reinforcing it. As hereinbefore described, the net 14 comprises a series of first and second elements 15, 16; the net 14 is engaged with a containing element 1 so that the first elements 4 of this latter are substantially parallelly to the first elements of the net 14. In other words, the first elements 15 of the net 14 extend along the prevalent development directions substantially parallelly to the prevalent development plane of the facing body 2. In an operative condition of the structure 100, the prevalent development direction of each first element 15 of the net 14 is substantially horizontal. Referring to the second elements 16 of the net 14, these latter extend along paths transversal, particularly normal, to the directions of the first elements 15. Engaging the reinforcement net 14 with the reticular structure 3 of the containing element 1 is obtained by inserting and therefore interweaving one or more portions of the second elements 16—comprised between two immediately consecutive first adjacent elements 15—with a plurality of slots 13 of a second portion 3*b*. Each of the second elements 16 inserted in the slots 13 defines, with at least one second element 5 of the reticular structure 3 (of the second portion 3*b*) a closed outline loop receiving the locking element 19. De facto, the locking element is interposed between a second element 5 of the second portion 3*b* and a second element 16 of the reinforcement net 14: the locking bar 19 prevents the reinforcement net 14 from exiting the plurality of slots 13.

The reinforcement net 14 exhibits at least one portion arranged in a horizontal position inside the ground at the level of a plurality of aligned slots 13: a terminal portion of the net 14 is interwoven and constrained to a plurality of slots so that is integral with the facing body 2.

Figure 6A:
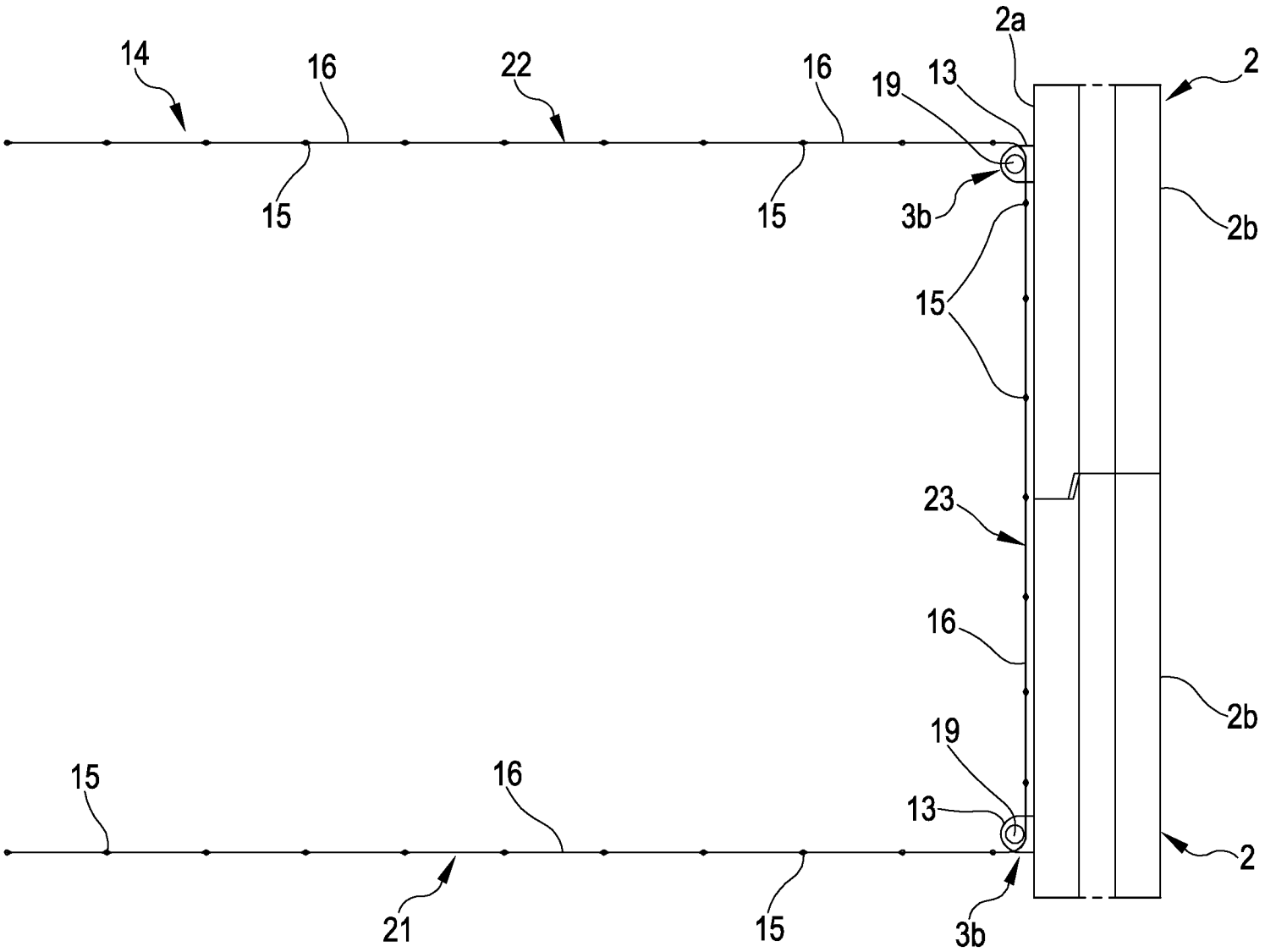
FIG. 6A is a schematic lateral view of a reinforced ground structure according to the present invention.

However, in a preferred but non limiting configuration of the invention, the net 14 defines plural layers exhibiting, according to a cross-section of the structure itself, a substantially two-dimensional development. Specifically, the reinforcement net 14 comprises at least one first and one second rectilinear segments 21, 22 (two segments), spaced from each other and positioned transversally, particularly normal, to the prevalent development plane of the facing body 2; the reinforcement net 14 further comprises at least one connecting segment 23 interposed between the first and second rectilinear segments 21, 22 and integrally joined to these latter: the connecting segment 23 extends parallelly to the inner face 2*a* of one or more facing bodies 2. De facto, in this two-dimensional configuration, the reinforcement net 14 defines, along a cross-section, a substantially "C" shape having a concavity facing away from the facing bodies 2. In this configuration, the reinforcement net 14 is interwoven and therefore is engaged—by means of respective locking bars 19—with two or more rows of slots 13 distinct and spaced from each other. Particularly, as it is visible for example in FIG. 6A, the connecting segment 23 of the reinforcement net 14 is integrally joined to two rectilinear segments (the first and second segments 21 and 22) by respective joining portions, each of them is interwoven with a plurality of slots 13 aligned along a same direction D: the locking bar 19 is interposed between a joining portion of the reinforcement net 14 and a plurality of slots 13 of one or more reticular structures 3. The joining portions represent actually net portions 14 radiused and inserted inside the plurality of slots 13. Providing a reinforcement net 14 according to a multilayer configuration, enables the same to be constrained to one or more pluralities of slots at different levels (see FIGS. 2 and 6A, for example). This enables the net 14 to be constrained to a plurality of slots 13 of the same facing body 2 or to constrain two different pluralities of slots of distinct facing bodies. This latter configuration is schematically illustrated in FIG. 6A wherein the same reinforcement net 14 is constrained below a plurality of slots 13 of a first underlying facing body 2 and, at the same time, to a plurality of slots 13 of an immediately adjacent second facing body 2 placed above the first body 2: the first net 14 segment emerges from the first underlying facing body 2, while the second segment 22 emerges from the upper facing body 2. The connecting portion or segment 23 of the reinforcement net 14 extends parallelly to both the facing bodies 2 and defines a connection between these latter.

It is useful to note that the geo-grids (the net 14 and the reticular structure 3) are coupled by means of the second stretched elements 5, 16 which exhibit a high tensile strength adapted to provide the geo-grids with an effective coupling.

Process of Making a Containing Element 1

Further, it is an object of the present invention a process of making a containing element 1 according to the present invention and particularly according to the present description and the attached claims. First of all, the process comprises a step of providing the reticular structure 3; this latter can be obtained by an extruded (or calendered, laminated or moulded) plate preform and then perforated (with dead holes or through holes). Alternatively, the reticular structure 3 can be made of a preform obtained by extruding precursors of the first elements 4 and simultaneously by forming precursors of the second elements 5 placed transversal to the precursors of the first elements. In the first case (perforated plate) it is obtained a preform having a constant thickness except obviously for the perforated areas, while in the second case it is obtained an artifact having a varying thickness. In case of a preform defined by a plate, the process will comprise at least one step of extruding the plate along an advancing direction and, immediately after forming the plate, a step of perforating the same for defining a flat perforated preform. After forming the perforated plate, this latter is stretched along the advancement direction of the same and/or transversally to the advancement direction. The first elements are formed so that the prevalent development direction of the same is normal to the advancement direction (advancement direction of the reticular structure). The stretching ratio is defined by the length of the elements (first and/or second elements) defining the preform to the length of the same at the end of the process immediately after being stretched. When the reticular structure is extruded, the first and second elements 4, 5 are made by a simultaneous extrusion process. For example, the plastic material is supplied by a hopper and then is delivered towards an extrusion head. At the extrusion head, the first elements 4 (or the precursors of the same elements) are extruded and the precursors of the second elements are co-extruded transversally to the first elements in order to form an integral reticular and tubular body exiting the extrusion head: the so formed body therefore is an integral monolithic plastic body.

After, there is a longitudinal cutting station which forms a reticular structural preform having the precursors of the first elements and precursors of the second elements: the precursors of the first elements develop, in a non limiting way, parallelly to an advancement direction of the reticular structure (the advancement direction of the co-extrusion process). Alternatively, it is possible to define precursors of the first elements transversally to the advancement direction of the reticular structure (transversally to the advancement direction of the co-extrusion process).

After forming the reticular structure preform, this latter is stretched transversally and/or parallelly to the reticular structure advancement direction in order to form said stretched reticular structure 3. The stretching step is performed immediately after forming and joining the precursors of the first and second elements (forming an unstretched net).

As hereinbefore described, the stretching step enables the reticular structure 3 to increase its tensile strength by increasing the temperature of the reticular structure 3 to more than 80° C., and then gripping the reticular structure itself for stretching it at least along the development of the second elements 5. The reticular structure 3 is taken to the stretching temperature by a hot air convection heating process or by hot water baths or by other heating systems.

By means of the described process, the first elements 4 positioned at a distance varying as a function of the pulsing frequency of the extrusion head (or perforation frequency when the starting material is a plate) and as a function of the longitudinally applied stretching ratio are obtained, while the second elements 5 are spaced from each other as a function of the pre-selected configuration for the extrusion head (or as a function of the distance between the punches in case the starting material is a plate), so that it is obtained a dimension of the meshes, varying according to the requirements and during the same manufacturing process. After, the reticular structure 3 is cut at a predetermined length, measured along the first or second elements.

Figure 25:
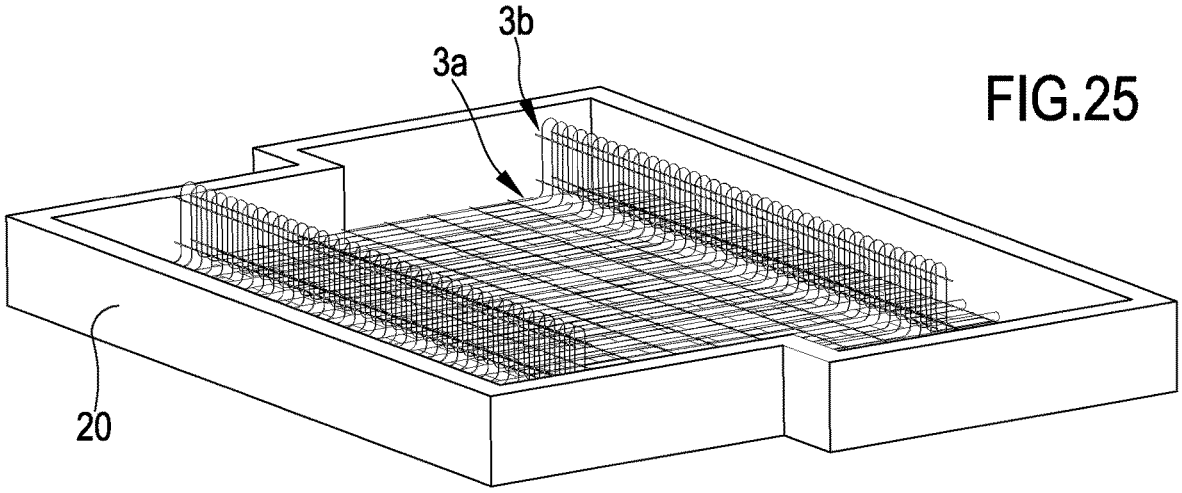
Figure 26:
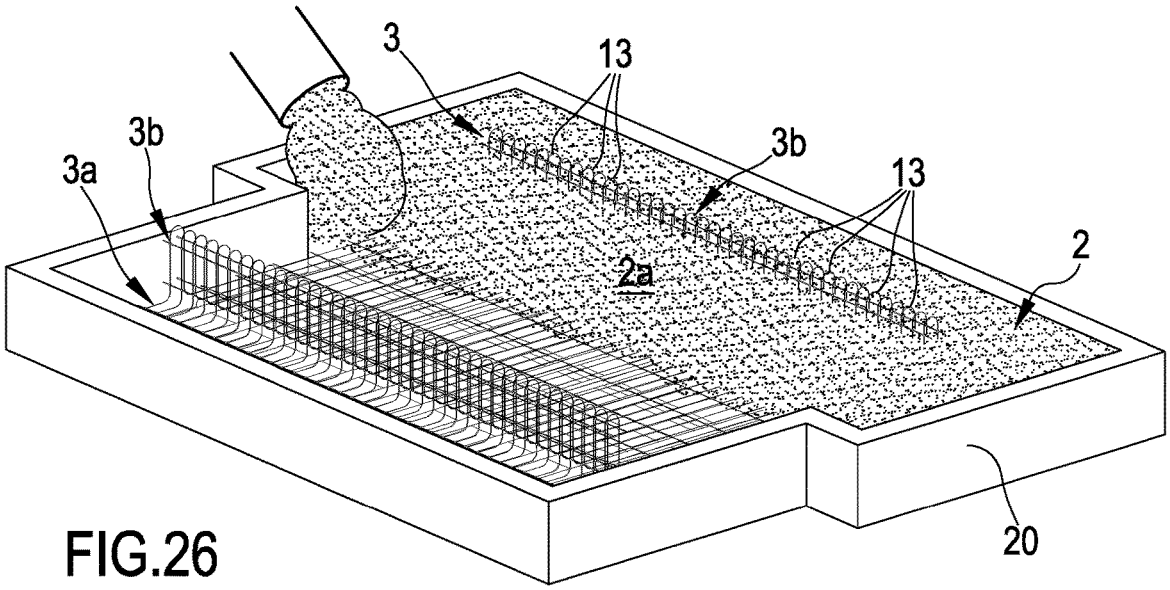

After providing the reticular structure 3, this latter is positioned inside a formwork 20 (FIG. 25) which, as it will be better described in the following, is used for forming the facing body 2. The reticular structure 3 is placed inside the formwork 20 and is folded, particularly folded one or more times along a folding direction parallel to the prevalent development direction of the first elements 4. Folding the reticular structure 3 defines at least a plurality of slots 13.

Further, the process can comprise, before positioning the reticular structure 3 in the formwork 20, providing at least one reinforcement 12 and positioning the same inside the formwork 20. After positioning the reinforcement 12, the process provides to position the reticular structure 3 in the formwork 20 on the reinforcement and/or inside this latter. De facto, the reinforcement 12 can be used for correctly positioning the reticular structure 3. Actually, the reticular structure 3 can be stably constrained to the reinforcement 12, for example by bands and/or similar elements, for enabling the structure itself to maintain a determined configuration, for example constraining the structure 3 to the reinforcement can help the structure 3 maintaining a folded configuration for defining said slots 13.

After positioning the reticular structure 3, and possibly the reinforcement 12, inside the formwork 20, the process provides to pour a predetermined quantity of a cementitious material, for example concrete, at least partially at a liquid state, inside the formwork 20. The step of pouring the predetermined quantity of material inside the formwork 20 enables to fill this latter to a predetermined level defining the inner face 2*a* of the facing body 2 and above which the plurality of slots 13 of the reticular structure 3 at least partially emerge. For obtaining the final facing body 2, it will be necessary to wait the hardening of the cementitious material inside the formwork 20: as hereinbefore described, part of the reticular structure 3 is embedded inside the facing body 2. It is useful to specify that providing the reticular structure 3, and pouring the predetermined quantity of cementitious material, enables to obtain the second portion 3*b* of the reticular structure. De facto, based on how much the reticular structure 3 has been folded and based on the quantity of material poured in the formwork 20, it is possible to define slots 13 having different size (actually it is possible to define the through area of the slots 13). The step of providing the reticular structure 3 enables to give to each slot a substantially "C" or "U" shape having a concavity facing the inner face 2*a* of the facing body 2; each slot 13 of the second portion 3*b* of the reticular structure 3 is integral with the facing body 2 and defines with the inner face 2*a* of this latter a closed outline loop. The step of providing the reticular structure 3 enables to define, for this latter, at least the following portions:

at least the first portion 3*a* exhibiting at least one first and one second flaps 8, 9 spaced from each other, embedded in the facing body 2 and ending at the inner face 2*a* of this latter, at least one second portion 3*b* exhibiting also a first and second flaps 10, 11 spaced from each other and integrally joined to the respective first and second flaps 8, 9 of the first portion 3*a* of the reticular structure 3.

FIGS. from 24 to 26 schematically illustrate the steps of providing a containing element 1 which comprises two portions 3*b* and a reinforcement 12. However, it is possible to provide containing elements as hereinbefore described and therefore having also only one portion 3*b* or more than two portions 3*b*. Further, it is possible to provide containing elements 1 without the reinforcement 12.

Process of Making Reinforced Ground Structures

Moreover, it is on object of the present invention a process of making a reinforced ground structure 100 according to the present invention, and particularly according to the previous description and attached claims.

The process comprises providing a plurality of containing elements 1 and providing a plurality of reinforcement nets 14. The reinforcement net 14 can be made by one of the described manufacturing processes of making the reticular structure 3. First of all, the process comprises finding the installation site and then escavating to a foundation depth (the minimum depth is 50 cm under the P.C.) and eventually reclaiming the underlying ground, according to the design specifications. Afterwards, the process provides the plano-altimetric tracing of the work by topographic measurements. Then, it is provided a step of pouring a predetermined quantity of cementitious material (for example concrete) for forming a base boot (non reinforced lower boot); the boot does not have a structural function but is used for enabling to correctly and efficiently position the containing element 1.

Figure 23:
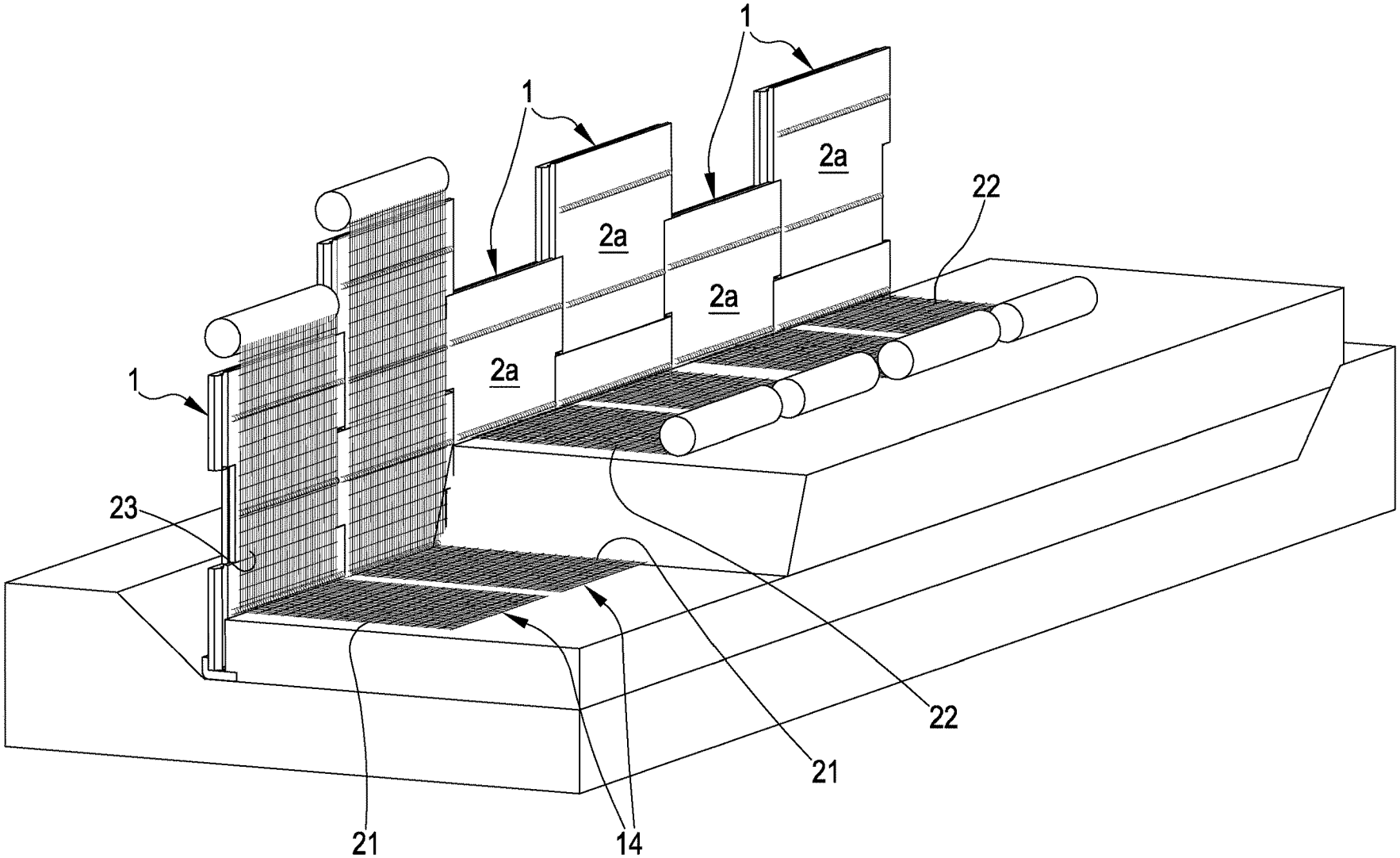
Figure 24:
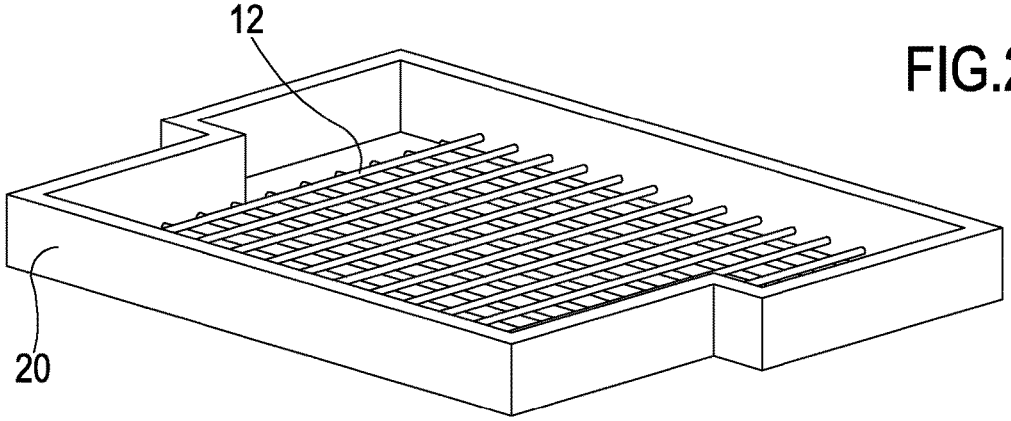

Then, the process provides to position a series of containing element 1 aligned along a predetermined path in order to form a type of wall wherein the inner faces 2*a* of the respective facing bodies 2 are all facing a same side. Particularly, the process comprises providing a plurality of containing elements 1 in order to define a plurality of horizontal rows of vertically overlapped containing elements 1. Based on the desired height to be obtained, two or more overlapped horizontal rows are provided. FIG. 23 illustrates, in a non limiting way, a configuration of a structure 100 exhibiting four rows of overlapped containing elements 1. Advantageously, the facing bodies 2 can comprise lateral guides configured for helping to position the bodies 2 themselves and facilitating their support: the guides are configured for enabling to anchor a facing body 2 to a flanked body.

After positioning the containing elements 1, the process provides to lay a first ground layer and compacting it in order to arrive at a first series of slots 13 of a containing element 1. Once arrived at a first series of slots 13, the reinforcement net 14 is positioned. Particularly, the process comprises laying at least one reinforcement net 14 at a plurality of slots 13 (above the first ground layer): the reinforcement net 14 extending from said plurality of slots 13 of a facing body 2 away from this latter in a rectilinear direction, particularly horizontal, in order to define a first segment 21. The first segment extends above the first ground layer.

Afterwards, at least one portion of said reinforcement net 14 is inserted in said plurality of slots 13; actually, a portion of the net 14 is interwoven with the slots 13 so that these can define a series of closed loops.

Successively, the process provides to engage at least one locking bar 19 between said plurality of slots 13 and the portion of the reinforcement net 14 inserted in this latter (the bar is inserted in the series of closed loops): the locking bar 19 being interposed between the plurality of slots 13 and reinforcement net 14 for stably constraining them. The net 14 can comprise the provision of only one segment 21 or, as hereinbefore described, can provide the segments 21, 22 and 23 (a two-dimensional net having a substantially "C" shape). In case the net is configured by several layers ("C" two-dimensional net), laying the net 14 provides to lay the first segment 21 on the first ground layer and lay the connecting segment 23 parallelly to the body 2. After laying the first segment 2 and possibly the connecting segment 23, the process provides to lay and compact a second ground layer on the first segment 21 until a further plurality of slots 13 is reached.

After providing the second ground layer, the process provides to lay a further net 14 portion on the second ground layer; the further net portion is then engaged with the further plurality of slots 13 by at least one locking bar 19 as hereinbefore described. In case the net exhibits the connecting element 23, the provision of the further net 14 provides to turn the same over the second ground layer: in this way it is defined the second segment 22. The second ground layer is therefore interposed between the first and second segments 21, 22. Therefore it is possible to repeat the above described steps for forming a plurality of ground layers and therefore arriving to an height such to cover the overall surface of the facing bodies 2.

Advantages of the Invention

Thanks to the invention, it is possible to obtain a containing element 1 and an associated reinforced ground structure 100 capable to effectively meet plural applications.

A substantial advantage is associated to the use of a plastic reticular structure 3 partially embedded in the facing body 2 and adapted to define a plurality of slots 13 to be anchored to the ground reinforcement elements. Using a plastic material reticular structure or net 3 prevents this latter from being subjected to corrosion/oxidation by the ground and therefore from damaging the net structure. Therefore, the reticular structure is adapted to define an effective and durable system with the time. Moreover, stretching the reticular structure 3 and using this latter for defining the slots 13 enable the reticular structure 3 to define strong and effective anchorings. De facto, the distinctive shape of the slots 13 of the portion 3*b* enables the containing element 1 to be easily constrained to outer reinforcement elements (to the net 14, for example) by only using the high tensile strength of the stretched elements (of the second elements 5 defining the second portion 3*b*, for example) without excessively loading the weak points of the structure 3, in other words the nodes 6. FIGS. from 16 to 18 illustrate a known connecting system defined between facing bodies and plastic nets. From these figures, it is apparent the structure of these systems and the associated disadvantages. Actually, contrary to what the Applicant has provided, the facing bodies exhibit nets partially integrated in the body, and defining rectilinear bands emerging from the body itself; a further ground reinforcement net is interwoven with the rectilinear band and is constrained to this latter by means of a bar. Once the nets are stretched, these, in contrast with what the Applicant has provided, concentrate the stresses just at the nodes, and consequently at the weaker/more fragile points of the nets. Often, for this reason, in the reinforced ground structures known to date, the reticular structure and/or reinforcement net are subjected to serious damages or even breaks compromising the reinforcement of the ground. A further advantage attributable to the configuration of the portion 3*b* of the reticular structure 3, is represented by the possibility of evenly distributing the stresses on the facing body 2. This enables to use facing bodies 2 of a small thickness and use locking bars of plastic material having also a small cross-section. De facto, the presence of a high number of second elements 5 enables the second portion 3*b* to evenly distribute the traction generated by the net 14. Evenly distributing the stresses enables to adequately size all the elements helping containing the ground, such as for example the locking bar 18 and net 14. In addition, by combining the reticular structure 3 (anchoring the facing body 2) with the plastic material reinforcement nets 14, it is possible to obtain an effective ground reinforcement. Moreover, the mono-oriented geo-grids or nets 14 (mono-stretched or substantially mono-stretched) having an integral junction as hereinbefore described, are reinforcing elements with a high module of elasticity and high strength of the junctions. The net 14 structure enables both to anchor the face and reinforce the ground from the inside in an uniform way, reducing in this way the thrust of the ground against the facing body 2 with a more effective action than the one provided by the anchoring systems formed by discrete strips or bars. Using geo-grids as reinforcement elements enables to evenly reinforce the ground from the inside and with a more effective action than the one provided by the anchoring systems formed by discrete strips or bands: the presence of the first elements 5 parallel to the facing wall, provides the net with a correct anchoring to the ground, while the second stretched elements 16 provide a high tensile strength and therefore they are more resistant to the thrust of the ground against the facing body 2 (the resistance to the extraction of the reinforcement 14 from the ground is greater). The above described characteristics enable to obtain the following advantages:

- a cost reduction in comparison with the preceding approaches using metal anchoring systems having a cost certainly higher than the one of the approach completely made of plastic of the Applicant;
- there is no limit in height. The high strength of the containing element 1 enables the structure 100 to develop to very high vertical extensions;
- an extremely durable system. The parts contacting the ground are made of plastic and concrete and therefore are not subjected to the ground corrosive/oxidating actions;
- it does not require any maintenance. The effective constrain and strength with time of the nets (reticular structure 3 and reinforcement net 14) prevents to implement processes for maintaining the containing elements 1 and/or nets 14;
- the constrain between the facing bodies 2 is increased. The reticular structure 3 and net 14 enable to generate strong links between adjacent bodies, making them integral to each other;
- the system has an easier and speedier implementation. The step of laying only one carpet of nets 14 is certainly speedier and simpler than a system that comprises providing and engaging single bands and/or strips;
- the quantity of material for the nets 14, required for obtaining a determined strength, is certainly reduced with respect to the material required by a bands or strips system; the quantitative and economical effect of the net 14 reinforcement, being equal to the laid vertical facing surface, is smaller.

The invention claimed is:

1. A structure of reinforced ground, comprising:

a plurality of containing elements for geotechnical applications comprising:

at least one facing body associable to a ground for defining a containment and support to the ground, the at least one facing body comprising at least one inner face configured for contacting the ground and one outer face opposite to the at least one inner face with respect to the facing body itself, at least one reticular structure having a plurality of first elements spaced from each other and developing along prevalent development paths, the at least one reticular structure having further a plurality of second elements also spaced from each other which extend along respective prevalent development paths along a direction transverse to the plurality of first elements, the plurality of first and second elements intersecting each other at respective nodes in order to form meshes, the at least one reticular structure comprising at least one first portion integrated and stably embedded in the at least one facing body and at least one second portion, integral with the at least one first portion, emerging from the at least one inner face of the at least one facing body, and wherein the at least one second portion of the at least one reticular structure defines a plurality of slots, the plurality of slots, in cooperation with the at least one inner face of the at least one facing body, defining a closed outline loop, wherein the plurality of slots defines, along a predetermined direction, a single channel longitudinally delimited by terminal opposite slots, the at least one reticular structure being made of a monolithic plastic material, said containing elements, according to an operative condition of the plurality of containing elements, being arranged in a vertical position by overlapped rows, each of the plurality of containing elements containing elements exhibiting the at least one second portion of the reticular structure emerging from the at least one inner face of the at least one facing body in order to define the plurality of slots, a predetermined number of monolithic reinforcement nets of a plastic material, each of the predetermined number of monolithic reinforcement nets comprising the plurality of first elements spaced from each other and developing along the prevalent development paths, each of the predetermined number of monolithic reinforcement nets further exhibiting the plurality of second elements also spaced from each other which extend along respective ones of the prevalent development paths in a direction substantially transverse to the plurality of first elements, the plurality of first and second elements intersecting each other at respective nodes in order to form the meshes, at least a series of second elements, of the plurality of second elements, of the predetermined number of monolithic reinforcement nets, comprised between two adjacent immediately consecutive ones of the plurality of first elements, being inserted and interwoven with the plurality of slots of the containing element, the structure further comprising:

at least one locking bar engaged inside the channel defined by the plurality of slots so that the series of second elements of each of the predetermined number of monolithic reinforcement nets is interposed between the at least one facing body and the at least one locking bar, the at least one locking bar being configured for stably constraining each of the predetermined number of monolithic reinforcement nets to the plurality of containing elements.

2. The structure according to claim 1, wherein each of the predetermined number of monolithic reinforcement nets exhibits at least one portion placed in a horizontal position inside the ground at a level of a plurality of aligned ones of the plurality of slots.

3. The structure according to claim 1, wherein the at least one locking bar is made of a plastic material.

4. The structure according to claim 1, wherein the second portion of the at least one reticular structure comprises at least the plurality of second elements emerging from the at least one inner face of the at least one facing body and defining said plurality of slots, the plurality of second elements being aligned along a predetermined rectilinear direction and parallel to a prevalent development plane of the at least one facing body itself.

5. The structure according to claim 4, wherein the second portion of the at least one reticular structure comprises, for each linear meter measured along a predetermined direction of aligning slots, a number of the plurality of second elements greater than 10.

6. The structure according to claim 1, wherein the plurality of second elements are stretched along a prevalent development direction of the plurality of second elements after formation of the plurality of second elements and have a structure having molecular chains oriented along the prevalent development direction.

7. The structure according to claim 1, wherein the plurality of second elements are obtained by extrusion and are then stretched, wherein the plurality of second elements have a stretching ratio greater than 3, the stretching ratio of the plurality of second elements being defined as a ratio between a final length of the plurality of second elements after having stretched the plurality of second elements to an initial length of the plurality of second elements before stretching them.

8. The structure according to claim 1, wherein the plurality of first elements are not stretched or have a stretching ratio less than one of the plurality of second elements, the stretching ratio of an element of the plurality of first and second elements being defined as a ratio between a final length of the element once the element has been stretched to an initial length of the element before stretching the element.

9. The structure according to claim 1, wherein the at least one facing body is in a cementitious material.

* * * * *